US007867149B1

(12) United States Patent
Webber et al.

(10) Patent No.: US 7,867,149 B1
(45) Date of Patent: Jan. 11, 2011

(54) SWIVELING USER SUPPORT FOR EXERCISE MACHINE

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 152 days.

(21) Appl. No.: 12/179,425

(22) Filed: Jul. 24, 2008

Related U.S. Application Data

(60) Provisional application No. 60/952,424, filed on Jul. 27, 2007.

(51) Int. Cl.
*A63B 21/08* (2006.01)

(52) U.S. Cl. ..... 482/97; 482/100; 482/137

(58) Field of Classification Search ..... 482/52, 482/57, 93, 96, 97, 100, 136–137, 140, 146; 248/417
See application file for complete search history.

(56) References Cited

U.S. PATENT DOCUMENTS 3,207,464 A * 9/1965 Hrach ..... 248/417
3,367,613 A * 2/1968 Christensen ..... 248/145
3,999,702 A * 12/1976 Conroy ..... 232/39
4,387,893 A * 6/1983 Baldwin ..... 482/137
4,623,144 A 11/1986 Rockwell
4,627,619 A 12/1986 Rockwell et al.
4,729,562 A 3/1988 Pipasik
4,836,536 A * 6/1989 Jones ..... 482/134
5,007,675 A * 4/1991 Musto et al. ..... 297/215.14
5,052,684 A * 10/1991 Kosuge et al. ..... 482/118
5,056,779 A * 10/1991 Webb ..... 482/137
5,094,449 A * 3/1992 Stearns ..... 482/130
5,167,364 A * 12/1992 Wenning ..... 232/39
5,346,447 A 9/1994 Stearns
5,360,383 A * 11/1994 Boren ..... 482/10
5,577,987 A 11/1996 Brown
5,665,041 A * 9/1997 Hsieh ..... 482/140
5,669,865 A * 9/1997 Gordon ..... 482/142
5,681,250 A 10/1997 Hoover et al.
5,692,997 A * 12/1997 Stearns ..... 482/100
5,702,332 A * 12/1997 Hsieh ..... 482/130
5,749,813 A 5/1998 Domzalski (Continued)

OTHER PUBLICATIONS

AB Doer Extreme, web page, http://www.asseenontv.com/prod-pages/ab_doer_xtrm.htmI?gid=, printed Jun. 25, 2008, earliest date unknown.

(Continued)

*Primary Examiner*—Fenn C Mathew
*Assistant Examiner*—Andrew M Tecco
(74) *Attorney, Agent, or Firm*—Procopio, Cory, Hargreaves & Savitch LLP

(57) ABSTRACT

A swiveling user support assembly has a user support or seat rotatably mounted on a user support mounting device or frame for rotation about a first pivot axis, while the mounting device or frame is pivotally or rigidly connected to a main frame of an exercise machine. The user support has a base, and a primary user support and stabilizing device mounted on the base. A pivot connection between the base and mounting device or frame allows the user support to swivel from side to side about the first pivot axis. A centering mechanism helps to orient the user support in a central position for user entry or exit.

46 Claims, 27 Drawing Sheets

U.S. PATENT DOCUMENTS

| | | | | |
|---|---|---|---|---|
| D408,875 | S | 4/1999 | Anderson | |
| 5,902,220 | A | 5/1999 | Lin | |
| 5,938,575 | A * | 8/1999 | Stearns | 482/140 |
| 6,003,944 | A | 12/1999 | Glockl | |
| 6,015,370 | A * | 1/2000 | Pandozy | 482/97 |
| 6,168,557 | B1 | 1/2001 | Liao | |
| 6,186,926 | B1 * | 2/2001 | Ellis | 482/97 |
| 6,248,047 | B1 | 6/2001 | Abdo | |
| 6,379,289 | B1 | 4/2002 | Gossie | |
| 6,468,191 | B1 | 10/2002 | Cameron | |
| 6,475,120 | B2 * | 11/2002 | Johnston | 482/51 |
| 6,475,123 | B1 | 11/2002 | Evans | |
| 6,478,721 | B1 | 11/2002 | Hunter | |
| 6,491,611 | B1 | 12/2002 | Stearns | |
| RE38,057 | E * | 4/2003 | Pandozy | 482/97 |
| 6,544,154 | B2 | 4/2003 | Forcillo | |
| 6,575,884 | B1 | 6/2003 | Eazor | |
| 6,676,573 | B2 | 1/2004 | Abelbeck et al. | |
| 6,752,748 | B1 | 6/2004 | Scotti | |
| 6,966,872 | B2 * | 11/2005 | Eschenbach | 482/142 |
| D513,293 | S | 12/2005 | Panatta | |
| D520,084 | S | 5/2006 | McVay et al. | |
| 7,115,081 | B2 * | 10/2006 | Stearns | 482/140 |
| 7,150,702 | B2 * | 12/2006 | Webb et al. | 482/130 |
| 7,220,221 | B2 * | 5/2007 | Mosimann et al. | 482/100 |
| 7,494,181 | B2 * | 2/2009 | Tucker | 297/201 |
| 7,621,860 | B2 * | 11/2009 | Burrell | 482/142 |
| 2004/0204298 | A1 * | 10/2004 | Chen | 482/57 |
| 2005/0168017 | A1 * | 8/2005 | Pernicka et al. | 297/142 |
| 2006/0166799 | A1 | 7/2006 | Boland et al. | |
| 2006/0211549 | A1 * | 9/2006 | Nohejl | 482/97 |
| 2008/0085822 | A1 * | 4/2008 | Webb et al. | 482/140 |

OTHER PUBLICATIONS

AB Lounge, web page, http://ecx.images-amazon.com/images/I/4165nz401SI.SS500, printed Jun. 25, 2008, earliest date unknown.

AB Zone, web page, http://www.asseenontv.com/prod-pages/abzne_ontv.html, printed Jun. 25, 2008, earliest date unknown.

AB Rocket Abdominal Trainer, Amazon.com, http://www.amazon.com/gp/product/images/B000SALE1Q/ref=dp_otherviews_3?ie=UTF, printed Jun. 25, 2008, earliest date unknown.

Multi-Hinge Ab Crunch, Amazon.com, http://www.ecx.images-amazon.com/images/I/31MoMOIJHbL_SS500.jpg, printed Jun. 25, 2008, earliest date unknown.

Body Flex Clark Bartram's 3D Abs, web page, http://www.amazon.com/gp/product/images/B0007U9CRU/ref=dp_otherviews_1?ie=UTF, printed Jun. 25, 2008, earliest date known.

Red Seat, web page, http://ecx.images-amazon.com/imagesI/41FAV4zctWI.SS500.jpg, printed Jun. 25, 2008, earliest date known.

Abcore, Abcore Fitness 2005, web page, http://www.fitnessabcore.com/photos.htm#, printed Jan. 5, 2006, earliest date known.

Ab Coaster, Advertisement, date unknown.

Cybex Ab Crunch, Cybex Brochure 2001.

F-609 Abdominal Machine and F-611 Ab Flexor, Flex Brochure 1995.

Hoist HS1350 Rotary Torso and HS1310 Ab Crunch, Hoist Fitness Systems Brochure, 2005.

Posi-trak Work-Out Bench, Positrak Brochure, date unknown.

Abdominal Machine, Nautilus Brochure, 1997.

Power Crunch, Quantum Brochure, 2004.

03008 Abdominal Machine, Gym 80 Brochure, date unknown.

07008 Abdominal Machine, Gym 80 Brochure, 2001.

08005 Abdominal Multi-Joint Machine, Gym 80 Brochure, 2001.

712 Abdominal isolator, Icarian Brochure, date unknown.

Specification and Drawings for U.S. Appl. No. 12/179,412.

S-602 Rotary Torso, Hoist Fitness Systems, Inc., 1992, 1 pg.

Swedish Abdominal Twister, date unknown, 1 pg.

Owner's Manual for Hoist S-602 Torso Rotator, pp. 1, 3, 5, 8, 13 and 14, dated Sep. 1997.

* cited by examiner

SWIVELING USER SUPPORT FOR EXERCISE MACHINE

RELATED APPLICATION

The present application claims the benefit of U.S. provisional patent application No. 60/952,424 filed Jul. 27, 2007, which is incorporated herein by reference in its entirety.

BACKGROUND

1. Field of the Invention

This invention relates generally to exercise machines, and is particularly concerned with a swiveling user support for mounting on such machines.

2. Related Art

Exercise machines often have user supports which support a user in an exercise position during an exercise. Some machines have stationary user supports, while others have user supports which move during an exercise. Abdominal exercise machines are known which have a seat supported on a frame and an arm and head support which is mounted for rotary movement relative to the seat and which can be pulled down by the user in order to simulate an abdominal crunch exercise. One example is U.S. Pat. No. 6,186,926 of Ellis. The seat is fixed in position in this machine. In some abdominal exercise machines, the seat rotates up as the arm and head support rotates down towards the seat. Moving user supports or seats which are angled to one side can be awkward to sit on or get off, and can also make it difficult for the exerciser to position their body properly in order to perform an exercise. Other exercise machines are known in which all or part of a user support travels during an exercise, but these are typically not particularly versatile and only allow for exercise of one type of muscle or muscle group.

SUMMARY

An exercise apparatus in one embodiment comprises a swiveling exercise seat or user support that can freely swivel from side-to-side during an exercise, yet can be moved into a centered, forward facing orientation when the exercise is concluded and the user wishes to exit the seat.

The swiveling user support assembly in one embodiment comprises a user support mounting device or frame associated with the main frame of an exercise machine, and a user support or seat pivotally mounted on the user support mounting device via a pivotal connection which permits swiveling of the user support or seat from side to side about a pivot axis which extends transverse to the seat. In one embodiment, the user support has a base frame, a primary user support, a stabilizing support and a connection device mounted on the base frame. The connection device is designed for pivotal mounting to the seat support frame or user support mounting device so that the user support can swivel relative to the user support mounting device. The pivotal connection allows the user support to swivel through an arcuate path including a central, forward facing position. In one embodiment, a centering device helps to position the user support in the central, forward facing position when not in use or when not urged away from that position by a user positioned on the user support.

In one embodiment, the primary user support comprises a seat pad designed to support the user in a seated position when performing an exercise. In alternative embodiments, the primary user support may be designed to support a user in a different position, such as a kneeling or reclined position. In one embodiment, the stabilizing support is designed for engaging a seated user's feet or legs and aiding the user in controlling the swiveling action of the user support. These two supports are designed to travel together as the seat is swiveled.

In one embodiment, the base frame of the seat comprises a base member which supports the primary user support, and a support member mounted approximate the forward end of the base member which projects downwardly for transverse mounting of the stabilizing support. The connection device comprises a downward extending pivot shaft or axle attached to the under side of the base member which is designed for pivotal engagement with a pivot mount located on the seat support frame or seat mounting device.

In one embodiment, a centering device or mechanism between the base frame and the seat support frame aids in orientating the user support in a centered, forward facing position. In some embodiments, the seat or user support may have other forms of support in addition to the primary and stabilizing supports, in order to assist in stabilizing a seated user. These supports may travel with the seat as it rotates or may be stationary and fixed to another part of the machine framework. The seat support frame or seat mounting device may be stationary and rigidly mounted to a main frame of the exercise machine, or may be movable and pivotally mounted on the main frame.

In one embodiment, the exercise seat or user support can freely swivel from side-to-side during performance of an exercise, with the free swiveling movement controlled by the user and not connected to any substantive resistive load apart from the weight of a user sitting on the seat. User control of the swiveling movement uses core stabilizing muscles for balance as the user controls the movement of the seat while performing an exercise. At the same time, the seat can be centered when the user desires to enter or exit the seat.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
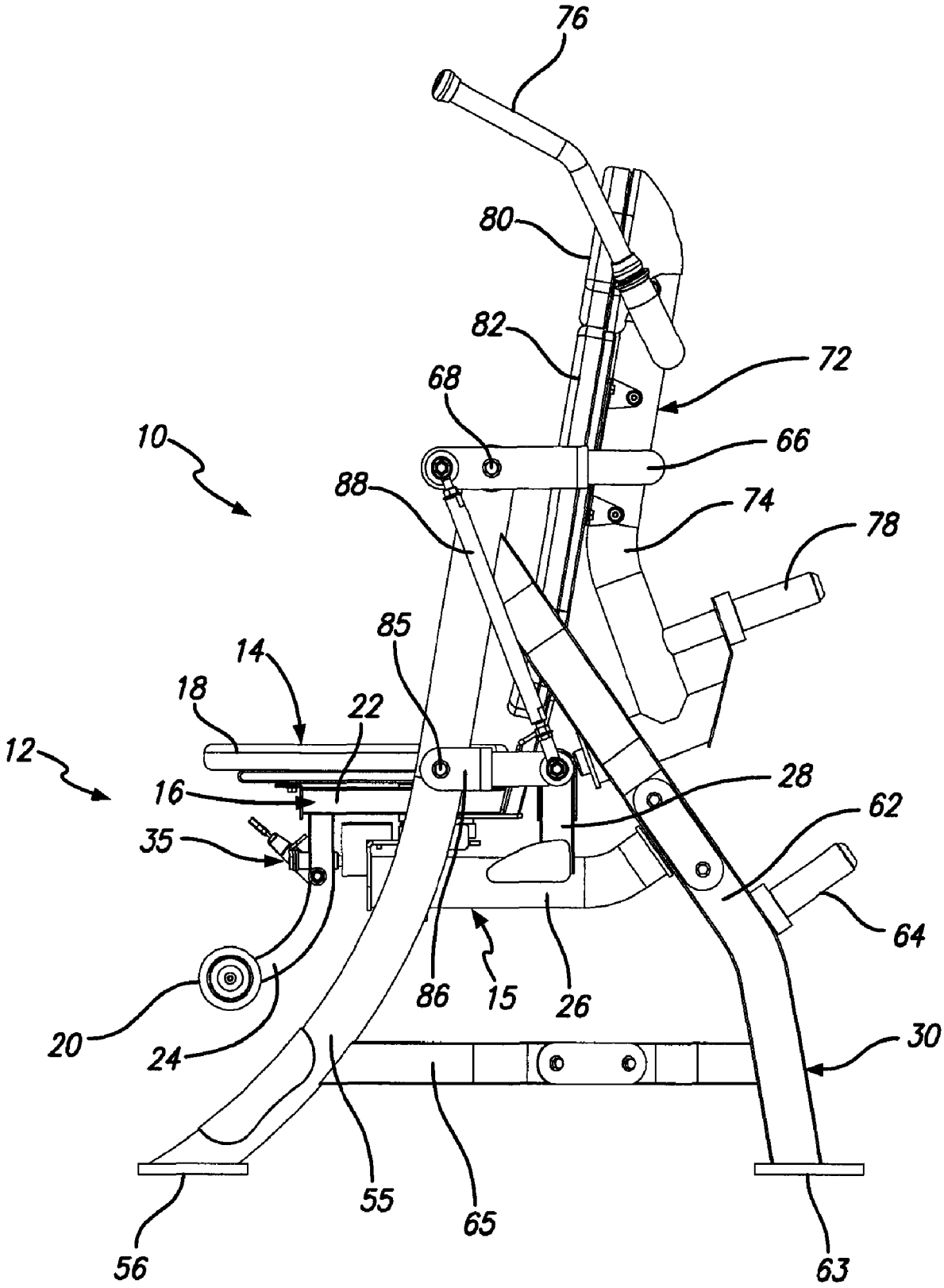
FIG. 1 is a side elevation view of a first side of an abdominal exercise machine having a swiveling seat assembly according to a first embodiment.

Certain embodiments as disclosed herein provide for a swiveling, self-centering exercise seat or user support for an exercise device or machine. In certain embodiments disclosed herein, a user support is pivotally mounted on a support frame or mounting device which may be pivotally connected to a stationary main frame or may be stationary and rigidly mounted to a stationary frame.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 13 illustrate an exercise machine 10 incorporating a first embodiment of a swiveling user support or exercise seat assembly 12. The user support assembly 12 basically comprises a user support or seat 14 pivotally mounted on a seat support frame or mounting device 15 which is associated with a main frame 30 of exercise machine 10. The seat assembly is illustrated separate from the remainder of the exercise machine in FIGS. 12A and 12B.

Figure 2:
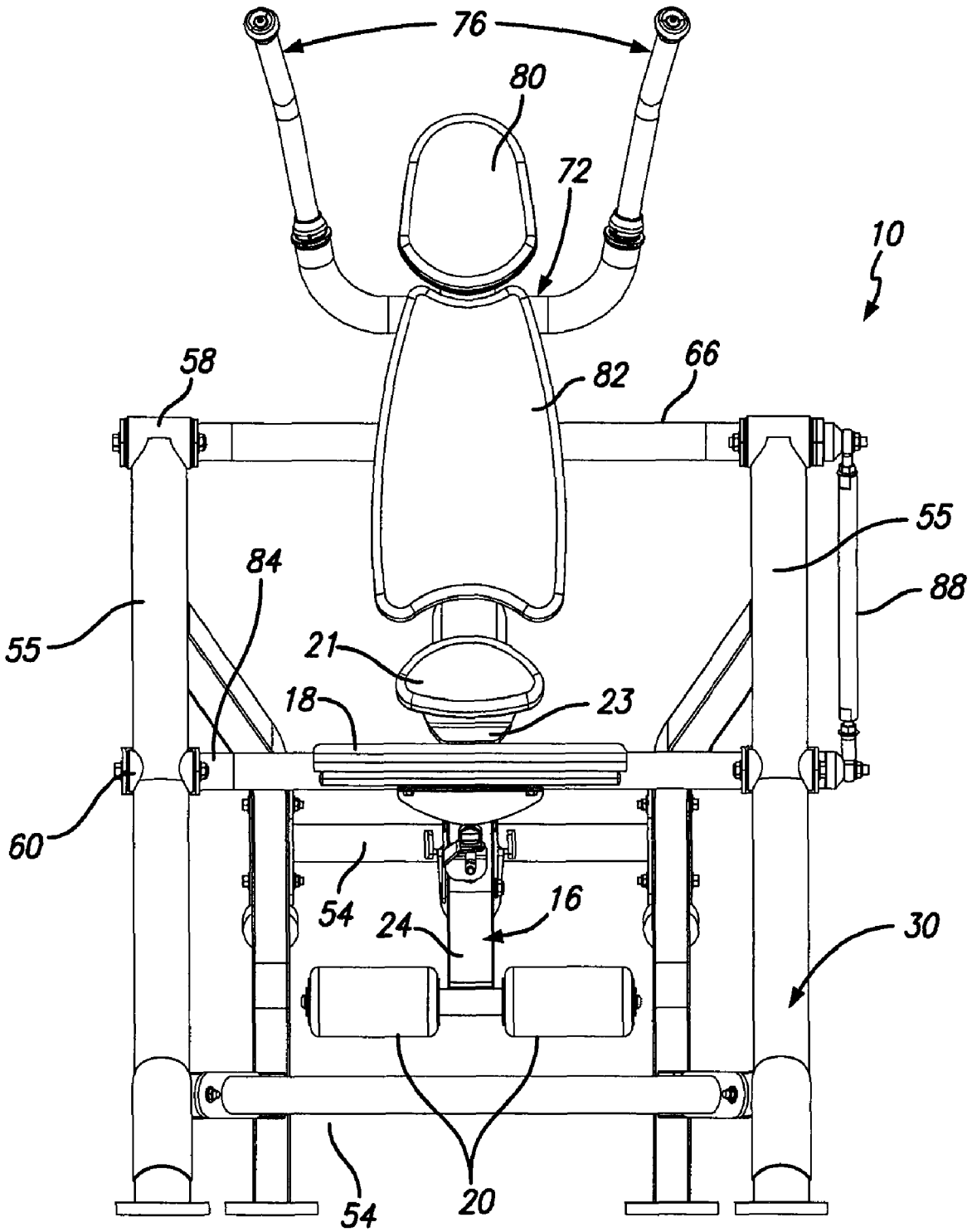
FIG. 2 is a front view of the machine of FIG. 1.
Figure 12B:
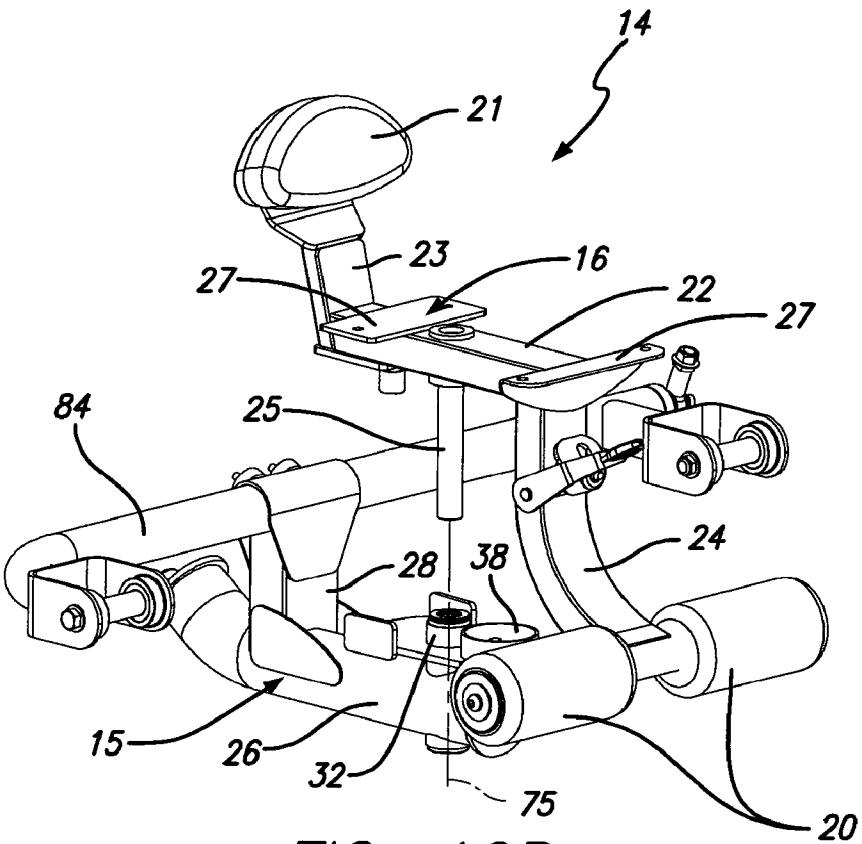
FIG. 12A and 12B are exploded views of the swiveling seat assembly of FIGS. 1 to 11 removed from the exercise machine.
Figure 12A:
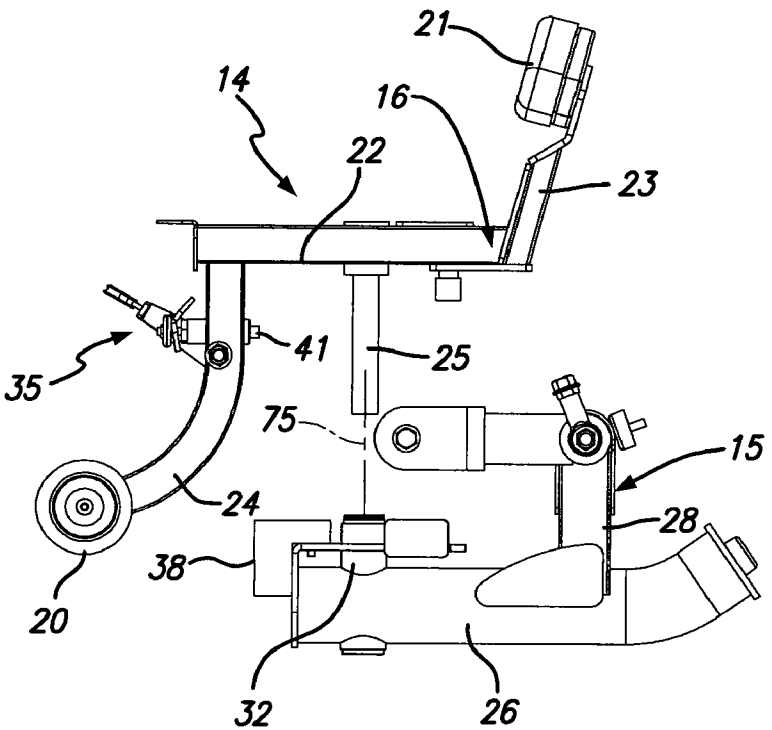

As illustrated in FIGS. 1, 12A and 12B, user support or seat 14 comprises a base 16 on which a primary user support or seat pad 18 and a stabilizing support 20 are mounted. The seat pad is omitted in FIG. 12 to illustrate the base of the seat more clearly. In one embodiment, the user seat 14 also has a secondary user support, in this case a tail bone pad 21 mounted on the base at a rear end of the seat pad 18. As illustrated in FIGS. 12A and 12B, the base 16 has a base tube or frame member 22 on which seat mounting plates 27 are secured. Seat pad 18 (not illustrated in FIG. 12) is mounted on mounting plate 27. Support tube or member 24 depends downwardly at a location approximate the forward end of the base tube, and curves outwardly adjacent its lower end. The stabilizing support 20 is mounted on support tube 24. In one embodiment, the stabilizing support 20 comprises a pair of roller pads transversely mounted at the lower end of support member 24, as illustrated in FIG. 2. In alternative embodiments, the roller pads may be replaced by shin or knee pads, foot plates, or a pad positioned to engage between the seated user's knees. Tail bone pad 21 is mounted on a rear frame member 23 projecting upwardly from the base tube at or approximate the rear end of the base tube 22. A pivotal connection pivotally connects the user seat 14 to the seat support frame or mounting device 15 so that user seat 14 can pivot or swivel about pivot axis 75 which extends transverse to the seat. In this embodiment, a first part of the pivotal connection comprises a pivot shaft or axle 25 which projects downwards from the under side of base tube or member 22, as illustrated in FIGS. 12A and 12B.

Figure 3B:
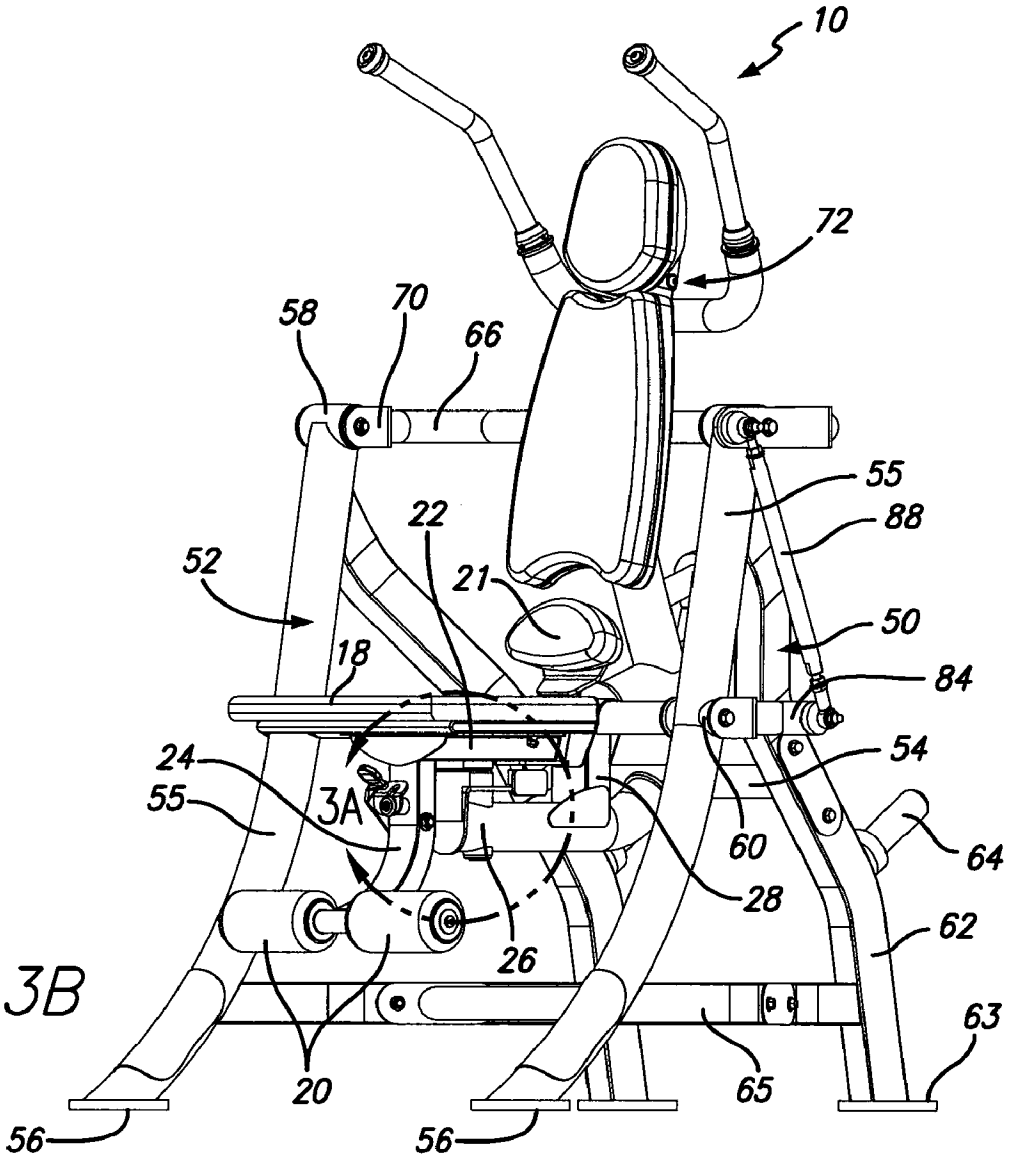
FIG. 3B is a front perspective view of the machine of FIGS. 1 to 3A with the seat locked in a central, forward-facing position ready for a user to enter or exit the machine.
Figure 3A:
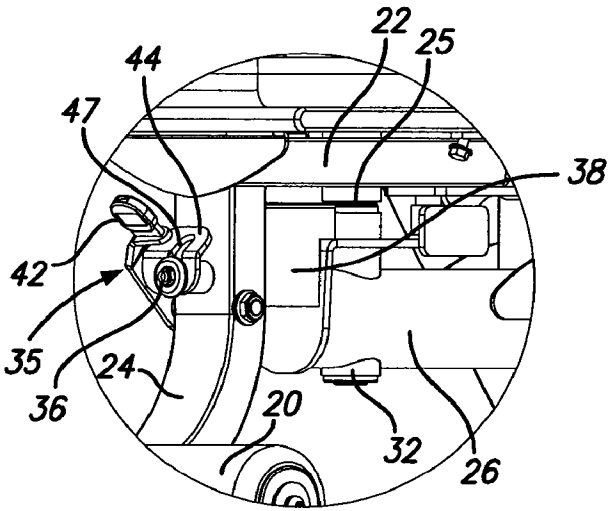
FIG. 3A is an enlarged perspective view of a self-centering device on the seat assembly of FIG. 1, with the device in a deployed position holding the seat in a central, forward-facing position.

In one embodiment, seat support frame or mounting device 15 comprises a main tube or arm 26 having an upwardly projecting strut 28 at a location spaced between its front and rear ends which is mounted on a cross strut 84, as illustrated in FIGS. 12A and 12B. Cross strut 84 is pivotally mounted on the main frame 30 of exercise machine 10, as illustrated in FIGS. 1, 2 and 3B and described in more detail below. In alternative embodiments, arm 26 may be rigidly mounted on a stationary frame. A vertical pivot mount or sleeve 32 adjacent the forward end of arm 26 receives the pivot axle 25 on the seat base 22 so that the user support seat 14 can pivot or swivel relative to seat support frame 15 about pivot axis 75 extending transverse to the user support base 16 and seat pad 18. Pivot axis 75 is vertical when the seat support frame 15 is in an exercise start position as illustrated in FIGS. 1 to 12. Stops (not illustrated) can be placed to limit the side to side pivot of the seat 14 so that it does not contact the main frame of the machine. In this case, seat 14 is free to swivel through arcuate path which includes the central forward facing position of FIGS. 1 and 2, with opposite ends of the path defined by the end stops.

Because entering and exiting a free swiveling seat can be awkward, a centering device or mechanism 35 is provided between the user seat 14 and seat support frame 15 in one embodiment of the user support assembly, as best illustrated in FIGS. 3 to 7 and 10 to 12. Centering device 35 may be used to temporarily secure the seat in a centered, forward facing orientation, as in FIGS. 3 and 4. The centering device 35 in one embodiment includes a ramping, spring loaded pull pin 36 mounted on the downwardly extending support member 24 of the seat base 16, above the foot pads 20. Pin 36 has a plunger 41 facing the forward end of arm 26. A curved ramping plate 38 on the forward end of the arm 26 has a central pinning hole 40 which receives the plunger 41 of the pull pin in the centered, extended and locked position of FIGS. 3 and 4. The curved surface of plate 38 on opposite sides of hole 40 provides a ramping surface to guide the plunger into the centered, locked position as the user swivels the seat towards a centered, forward facing position.

Figure 4:
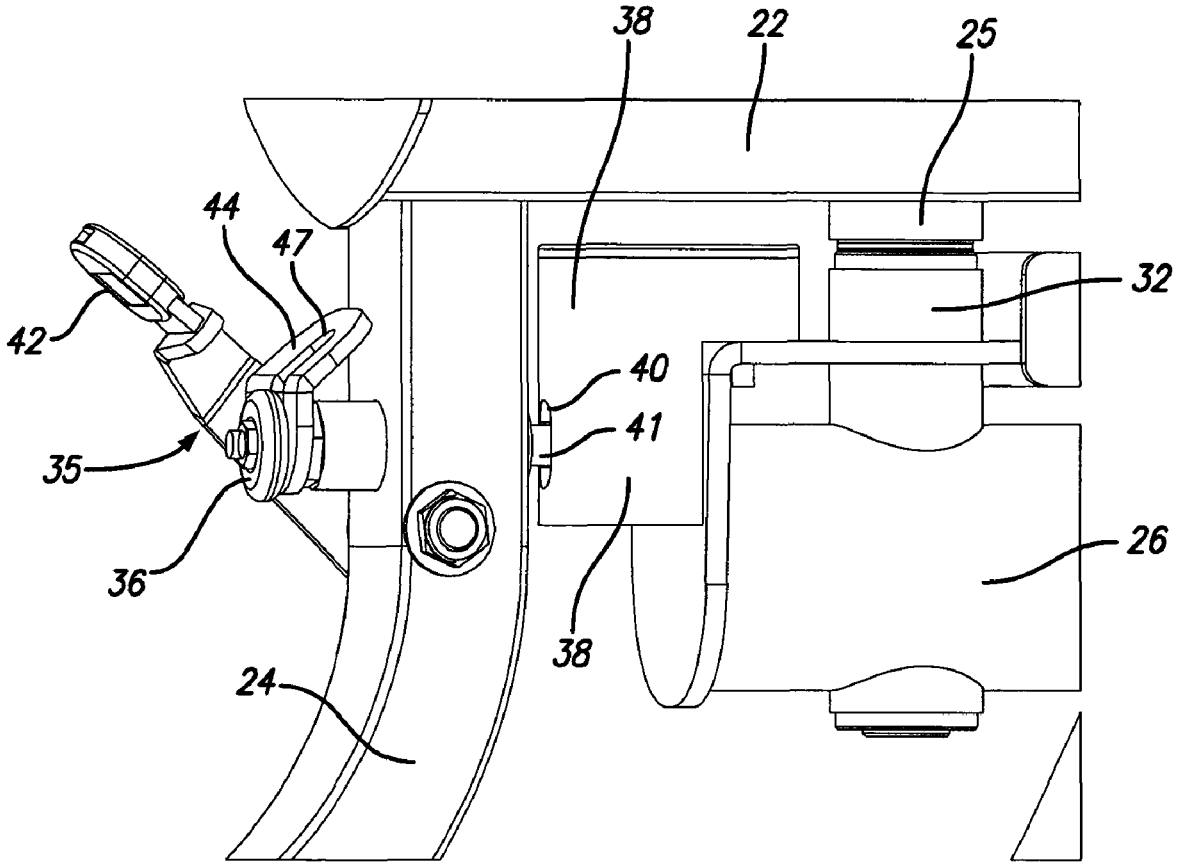
FIG. 4 is an enlarged perspective view of the self-centering device of FIG. 3A from a different angle.
Figure 5B:
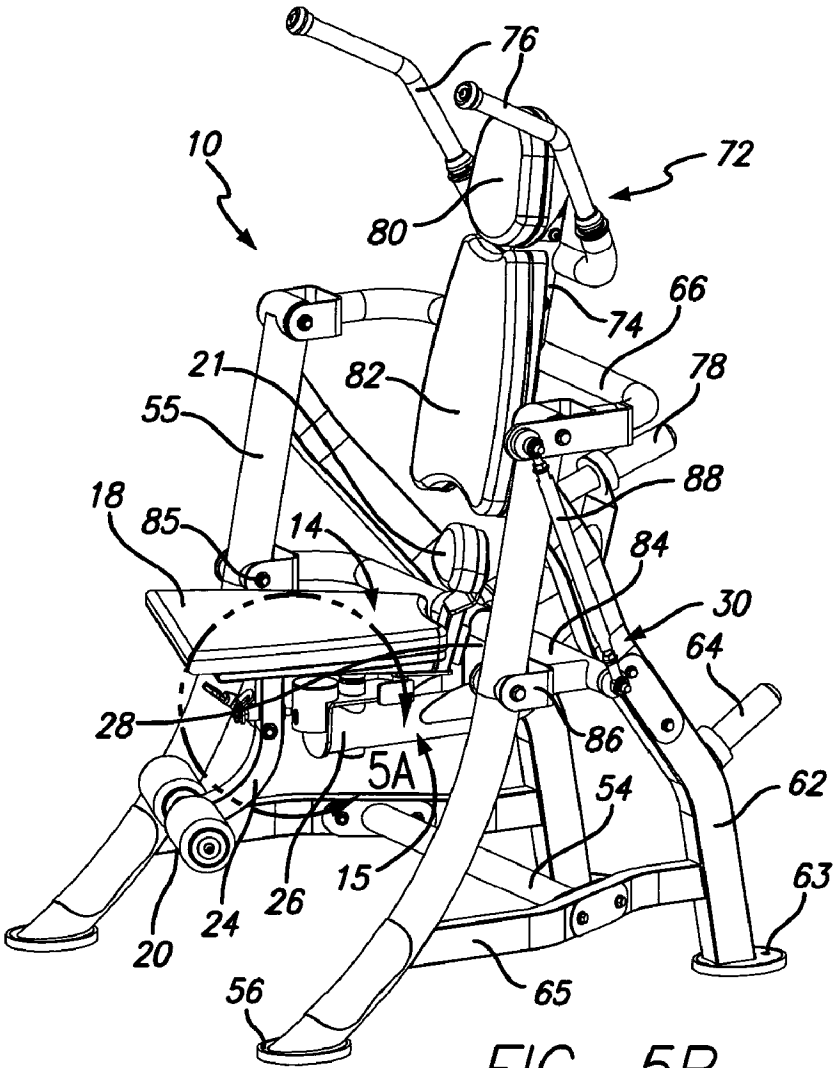
FIG. 5B is a front perspective view of the machine of FIGS. 1 to 4 but with the seat angled or swiveled to one side and the centering device in the position of FIG. 5A.
Figure 5A:
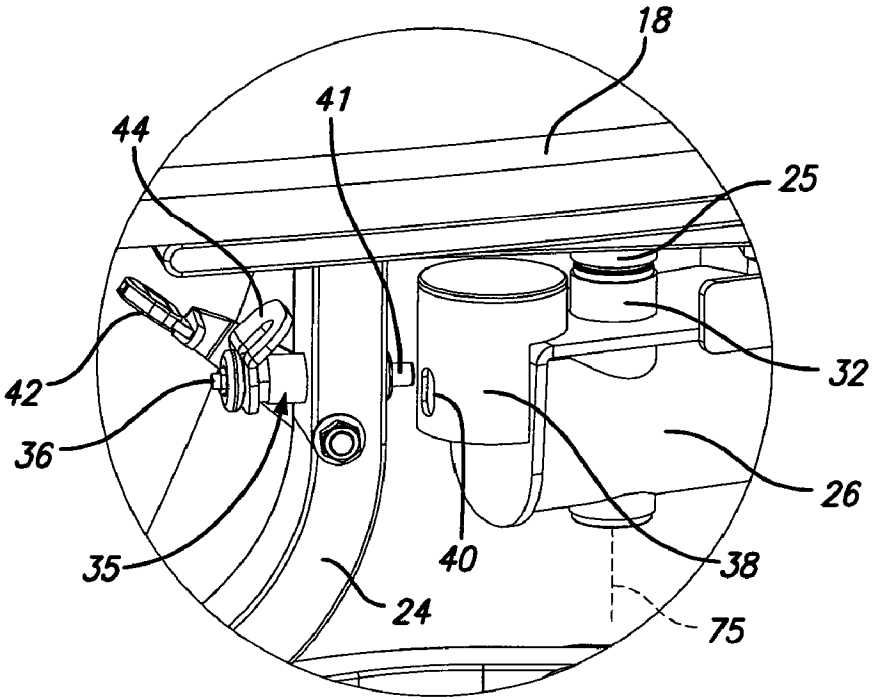
FIG. 5A is an enlarged view of the centering device similar to FIG. 3A, but with the seat swiveled and the pull pin of the centering device released and off-set from the pinning hole.
Figure 6:
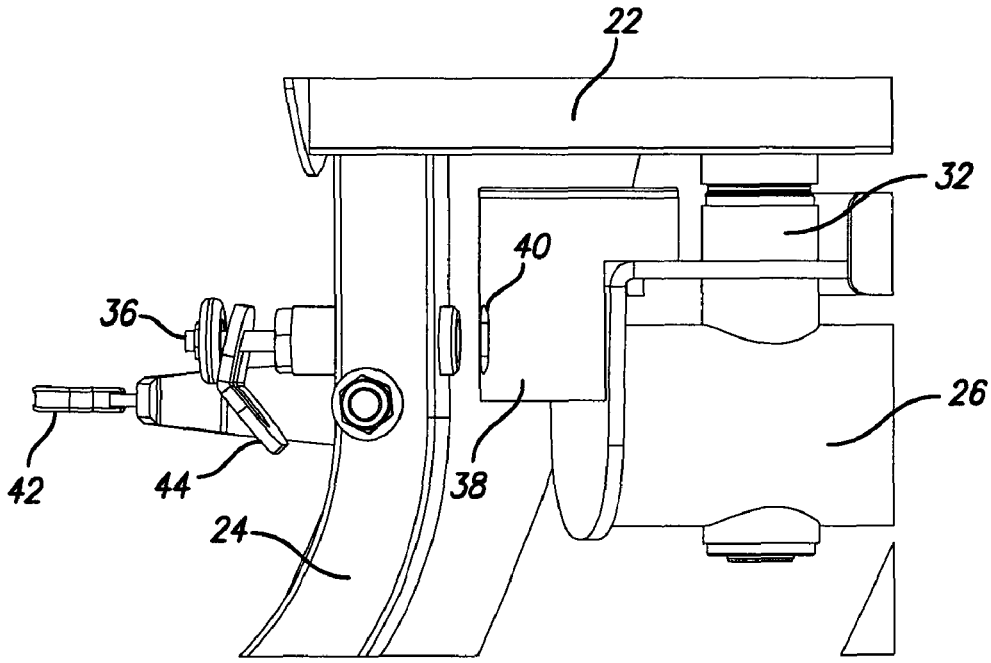
FIG. 6 is a side view of the centering device similar to FIG. 4 but with the activator lever in a down position and the pull pin plunger of the centering device in a retracted position unlocking the seat and allowing free swiveling movement of the seat.

As best illustrated in FIGS. 3A, 4, 5A, 6 and 7, an actuator lever 42 is pivotally mounted on the seat frame support member 24 adjacent the pull pin 36 and has an angled, plunger engaging tab 44 with a slot 47 engaging over the pull pin 36. Lever 42 is movable between the upper position of FIG. 3A, 4 and 5A and the lower position of FIGS. 6 and 7. Up and down movement of actuator lever 42 simultaneously moves the angled tab 44 from the position of FIG. 4, in which the plunger 41 is extended, and the position of FIG. 6, in which the plunger 41 is pulled back or retracted by the tab 44. As best illustrated in FIG. 6, the plunger 41 is held by the angled tab 44 in a retracted position spaced from the pinning hole when the actuator lever is in the lowered position.

In one embodiment, the swiveling user support assembly 12 is pivotally supported on the main frame 30 of the exercise machine 10 at a location spaced above the ground. The main frame has right and left side sections 50, 52 joined together by cross struts 54, as best seen in FIGS. 2, 3B and 5B. Each side section has a main upright 55 with a floor engaging foot 56 at the lower end and a first pivot mount 58 at the upper end or in the vicinity of the upper end. A second pivot mount 60 is located on the main upright at a location spaced below the first pivot mount 58. A supporting upright 62 is positioned rearward of the main upright and also has a floor engaging foot 63 at the lower end. Supporting upright 62 is joined at the upper end to the main upright below the first pivot mount 58, as illustrated in FIG. 1. A weight plate storage peg 64 is mounted on the rear side of each supporting upright to store hand loaded weight plates when they are not being used in the performance of the exercise. A support tube 65, positioned above the floor engaging feet, joins the front and rear uprights. The end stops for the user support seat swiveling movement may comprise bumpers or stop posts on the main upright 55 in one embodiment.

A first pivoting cross strut 66 has opposite ends pivotally mounted to the first pivot mounts 58 on each main upright for rotation about a first horizontal pivot axis 68. In one embodiment, the cross strut is "U" shaped with "U" shaped pivot mounting brackets 70 at each end. An exercise arm assembly 72 is mounted to the central web section of the first cross strut, as best illustrated in FIGS. 1 and 5B. The exercise arm assembly in this embodiment comprises an upright tube or rod 74 with a pair of user engaging handles 76 mounted approximate the upper end of the upright, a load receiving peg 78 mounted approximate the lower end of the upright, and user engaging head and upper back pads 80, 82 mounted on the front side of the upright. In alternative embodiments, the exercise resistance may be provided by a selectorized weight stack or other type of resistance mechanism.

The second pivoting cross strut 84 has opposite ends pivotally mounted to second pivot mounts 60 on each main upright for rotation about a second horizontal pivot axis 85, at a location spaced below the first pivot mounts. The second cross strut may be straight, curved, or of a general "U" shape with "U" shaped pivot mounting brackets 86 at each end. Connecting link 88 at one side of the main frame is pivotally connected to the first and second cross struts at its opposite ends, as illustrated in FIGS. 1, 2 and 3B. The seat support frame or mounting device 15 is mounted on the central web section of pivoting cross strut 84 via upright frame member 28 (see FIGS. 1, 12A and 12B) so that it pivots with the strut, and the user support or seat 14 moves with the seat support frame 15 as the frame pivots about axis 85, as described in more detail below with reference to FIGS. 13A and 13B.

Figure 13B:
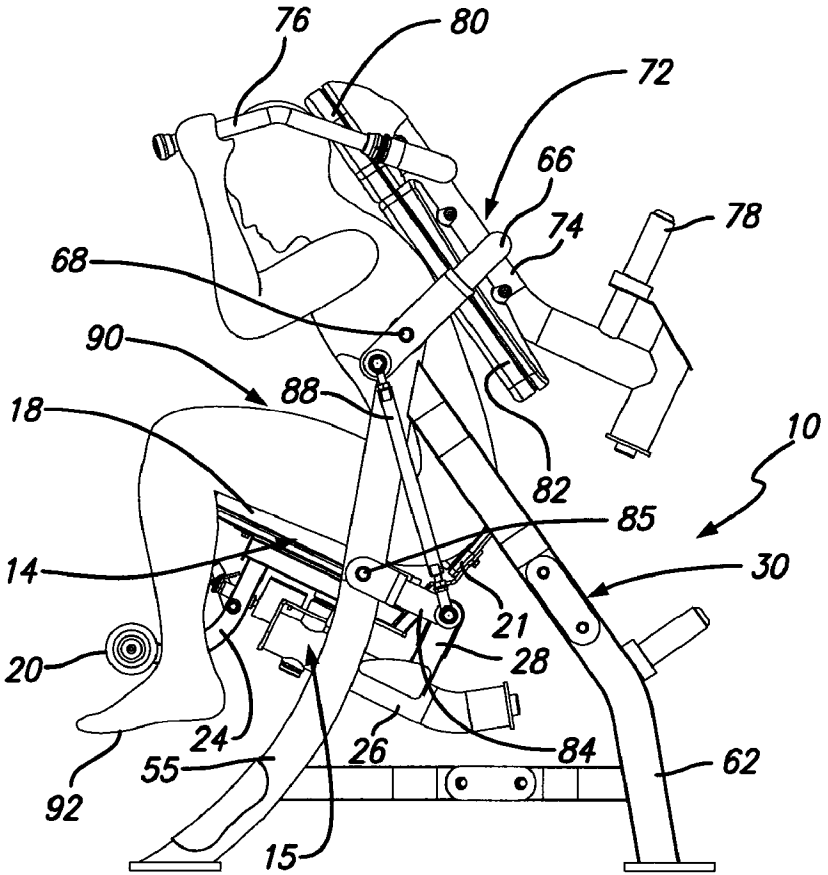
FIG. 13A and 13B show two different positions of a user seated on the user support and performing an exercise.
Figure 13A:
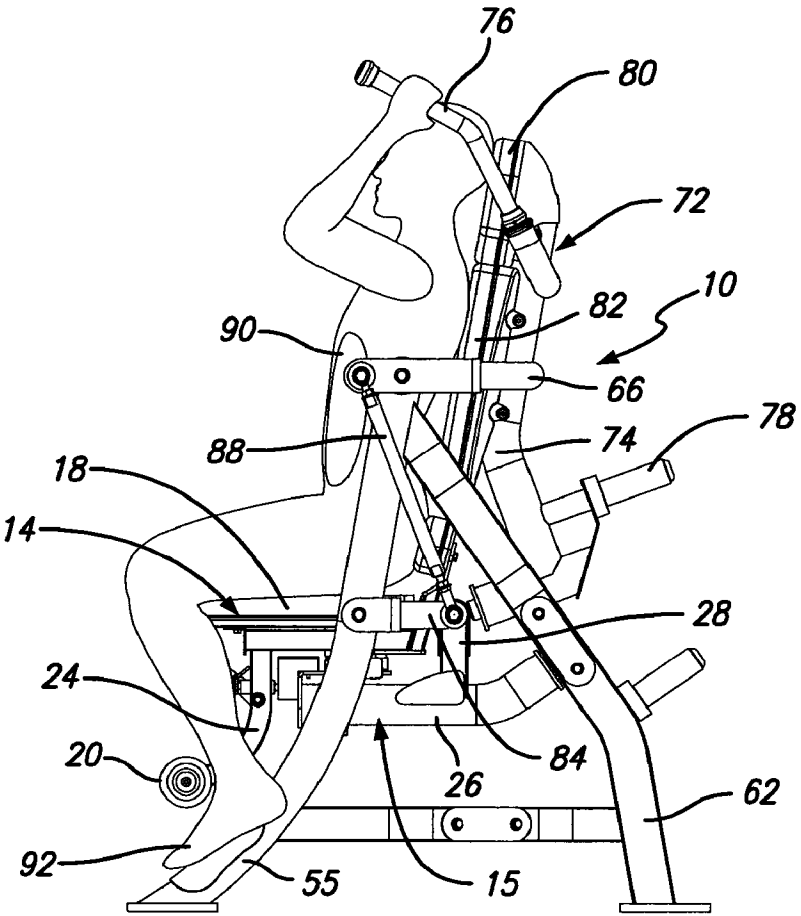

FIGS. 13A and 13A illustrate a side view of a user 90 performing an abdominal crunch exercise. They represent the start and finish positions for the exercise movement. To perform an exercise, the user 90 (see FIG. 13A) sits on the seat or primary support 18 with their buttocks up against the tail bone pad or secondary support 21, knees bent over the front edge of the seat pad and their feet 92 hooked behind the stabilizing roller pads 20. Prior to the user entering the seat, the centering device is engaged to lock the seat in a centered, forward facing orientation, with the actuator lever is in the upward position of FIGS. 3 and 4.

Figure 7:
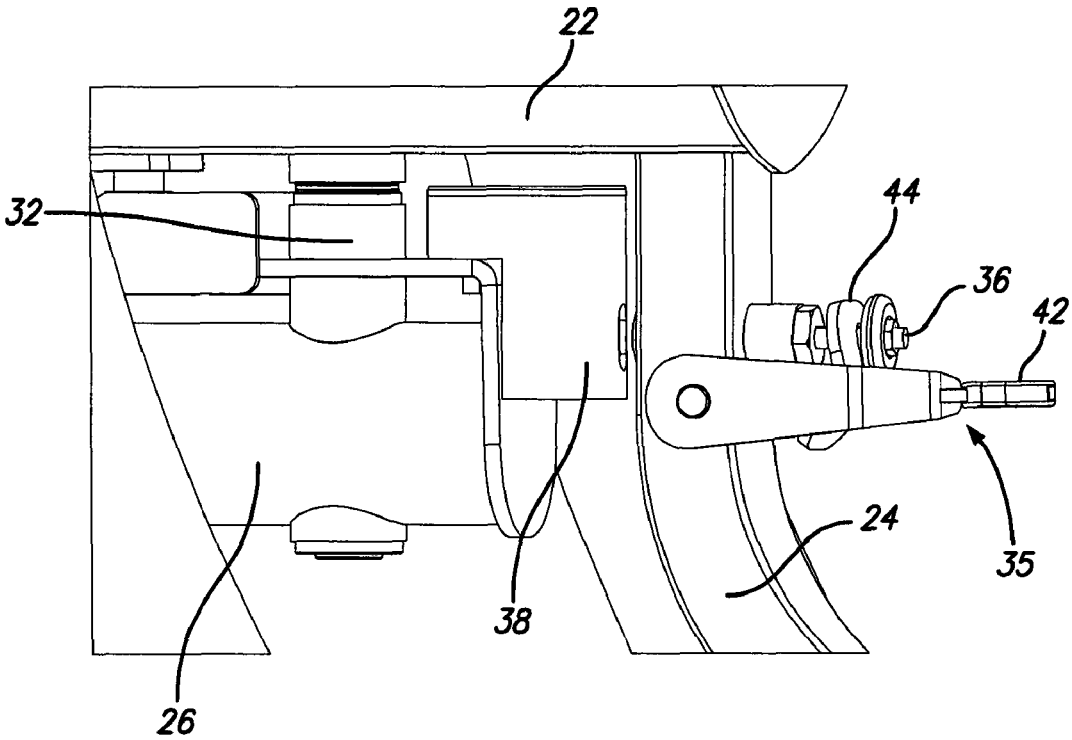
FIG. 7 is an opposite side view of the centering device in the position of FIG. 6.

Once properly positioned on the seat, the user flips the pull pin actuator lever 42 down into the position of FIGS. 6 and 7 to retract the pull pin plunger 41 and unlock the user support or seat 14 so that the seat can swivel freely from side to side. The user then engages the exercise arm and moves it along its exercise path. During the exercise, the pivotal connection of the user seat 14 to the seat support frame 15 allows the user to involve their torso muscles, regardless of the type of exercise they are performing. This could be voluntary, by pivoting the seat from side to side or involuntary when trying to keep the seat stationary. Swiveling through a full range of motion, side to side, involves the oblique muscles, upper and lower abdominal muscles as well as core stabilizing muscles. However, just trying to prevent the seat from swiveling during the performance of an exercise involves the core stabilizing muscles of the abdominal and low back.

Figure 8:
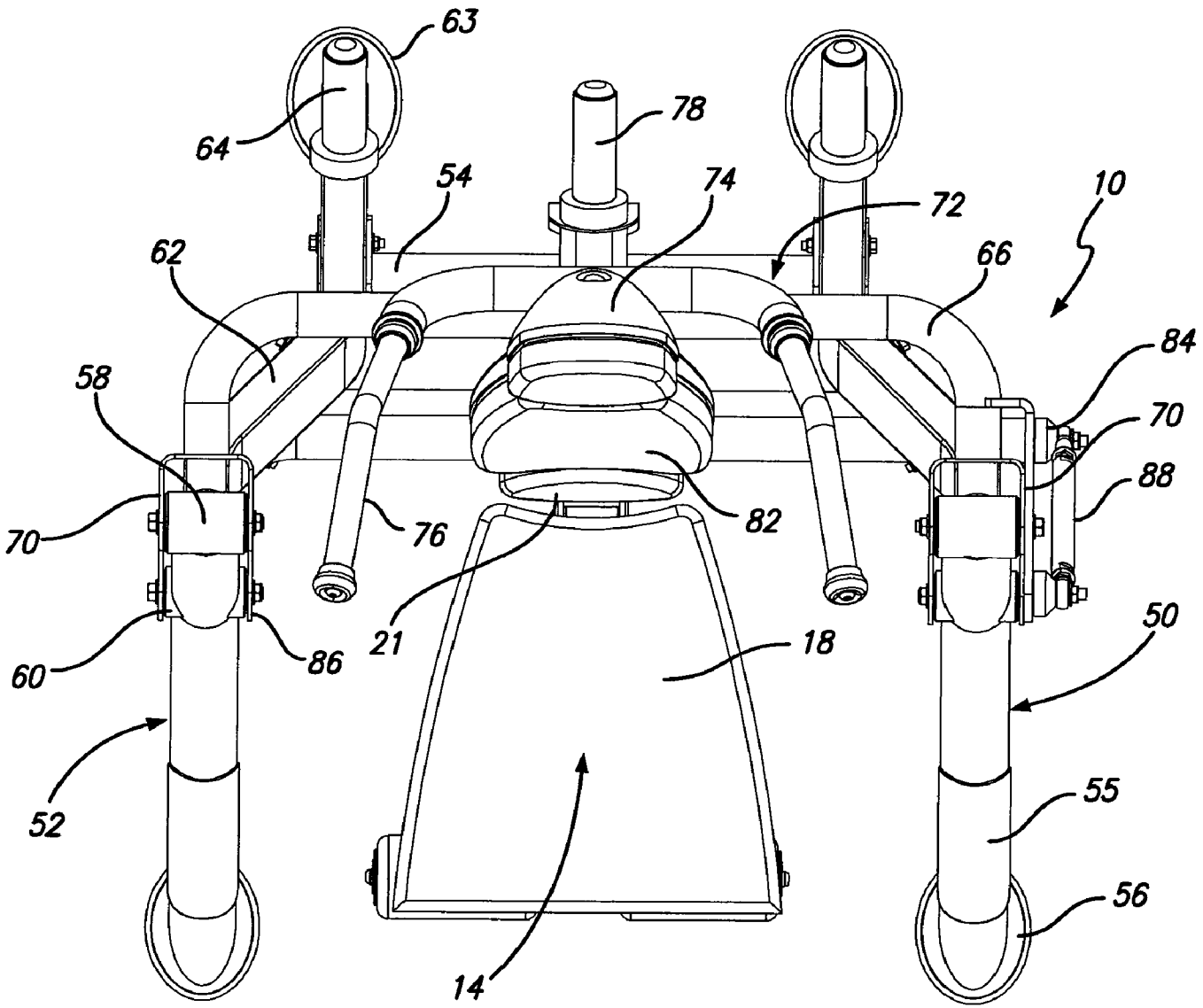
FIG. 8 is a top plan view of the machine of FIGS. 1 to 7 with the seat in a centered position.
Figure 9:
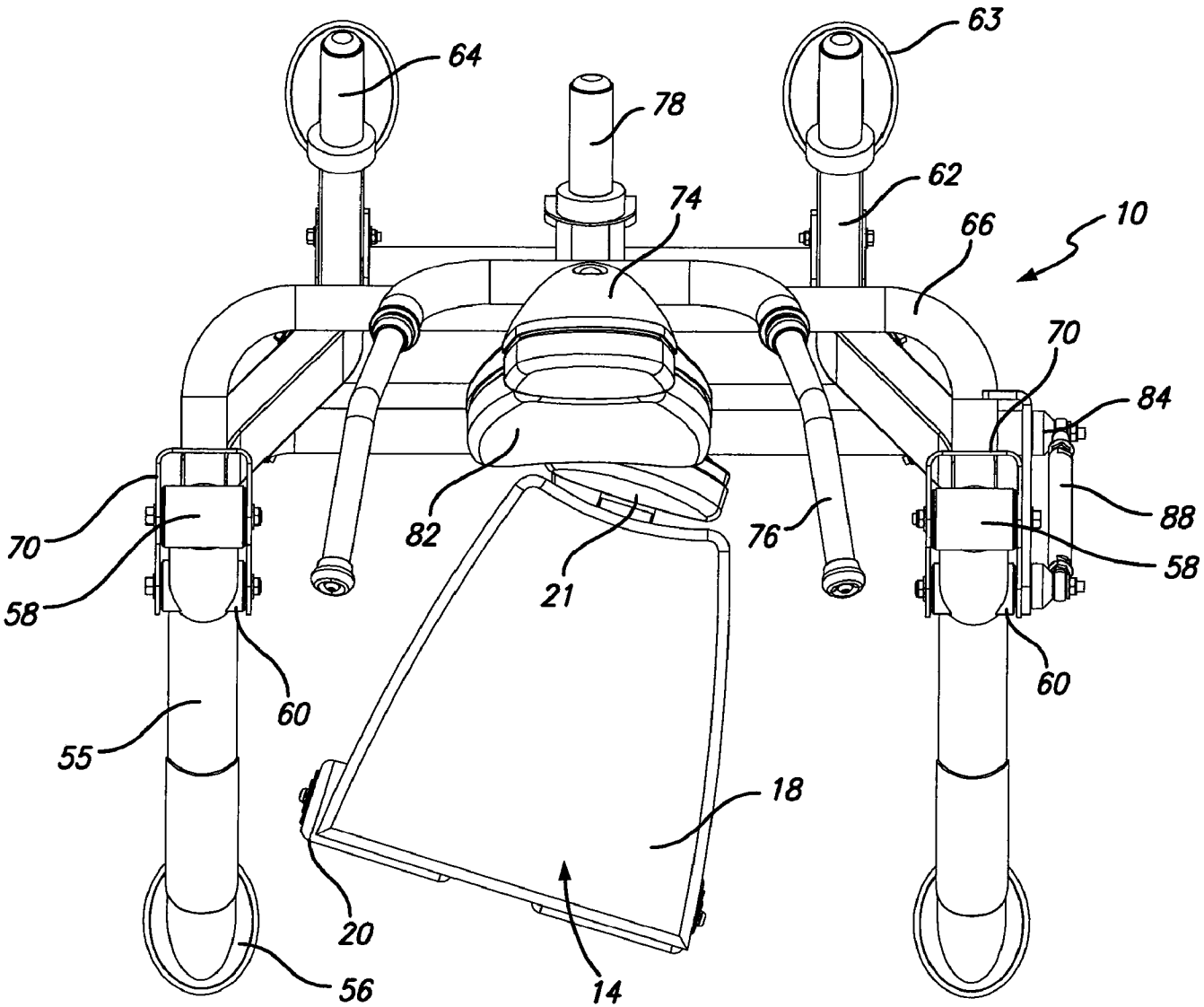
FIG. 9 is a top plan view of the machine similar to FIG. 8 but with the seat swiveled to one side.

The side-to-side swiveling motion of the user seat is best illustrated in FIGS. 8 to 11, with FIGS. 8 and 11 illustrating the seat 14 in a centered, forwardly facing position in which the centering device may be in a locked position to prevent swiveling of the seat, and FIGS. 9 and 10 illustrating the seat swiveled to one side. The seat pad 18 and part of the base member or tube 22 is removed in FIGS. 10 and 11 to illustrate the operation of centering device 35 more clearly. As noted above, the user moves the actuator lever 42 to the lower position of FIG. 6, retracting the plunger 41 from the pinning hole 40 and holding it in the retracted position (FIG. 6), when they wish the seat to be free to swivel. As the user support seat 14 is swiveled to one side relative to support frame 15, the primary support (seat pad 18), stabilizing support (leg or foot roller pads 20), and secondary support (tail bone pad 21) travel together in the same orientation.

Figure 10B:
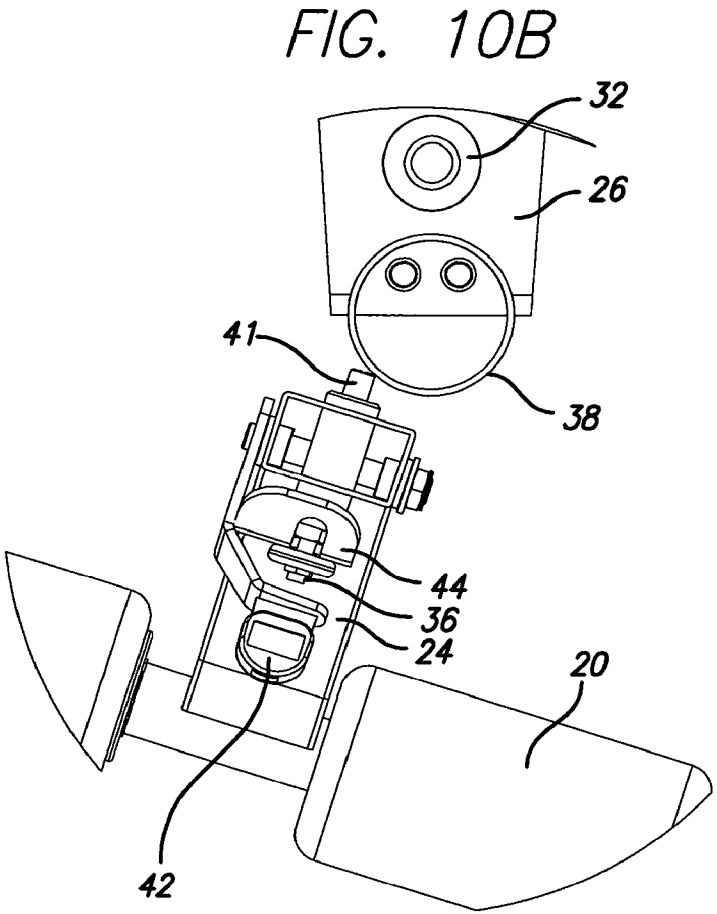
FIG. 10B is an enlarged view of the circled area of FIG. 10A.
Figure 10A:
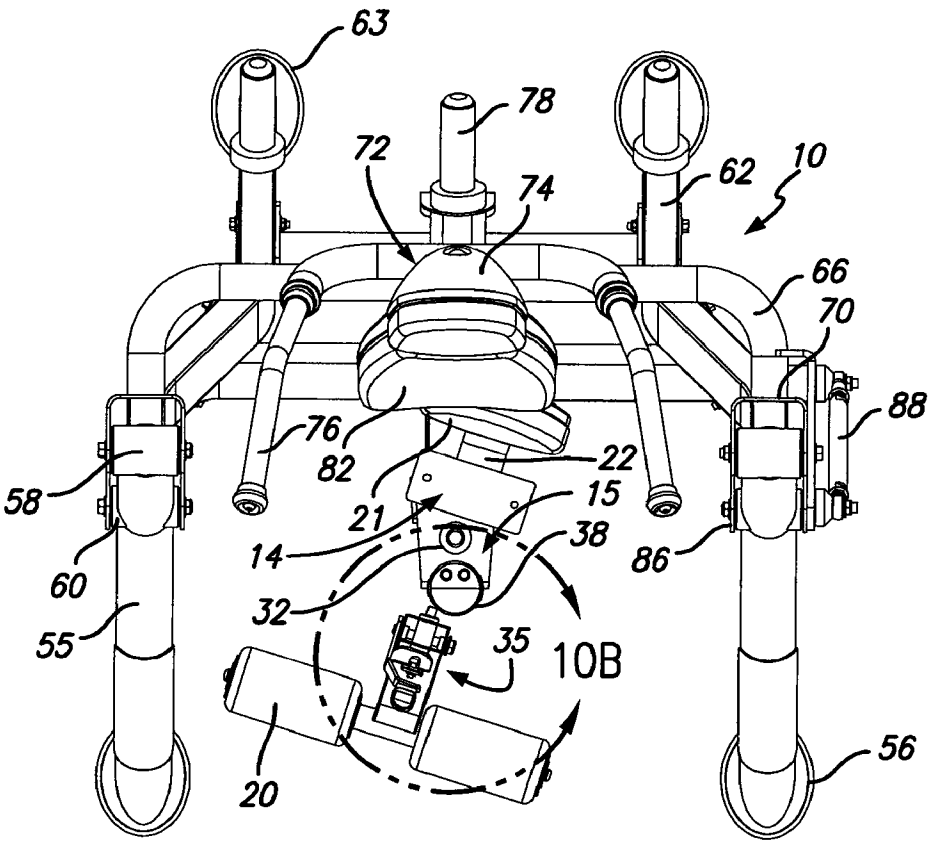
FIG. 10A is a top plan view of the machine similar to FIG. 9 but with the seat pad removed to reveal the centering device.
Figure 11B:
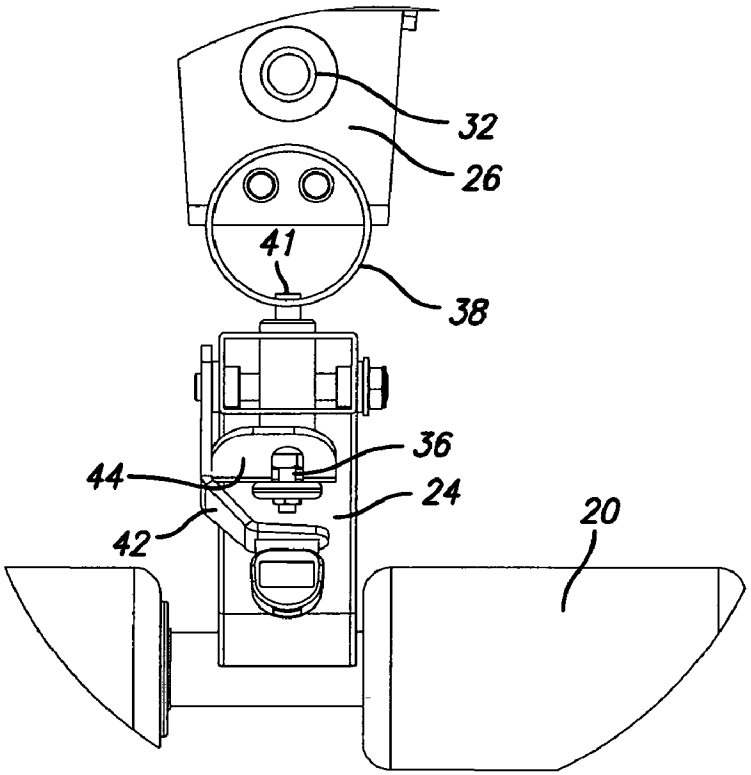
FIG. 11B is an enlarged view of the circled area of FIG. 11A.
Figure 11A:
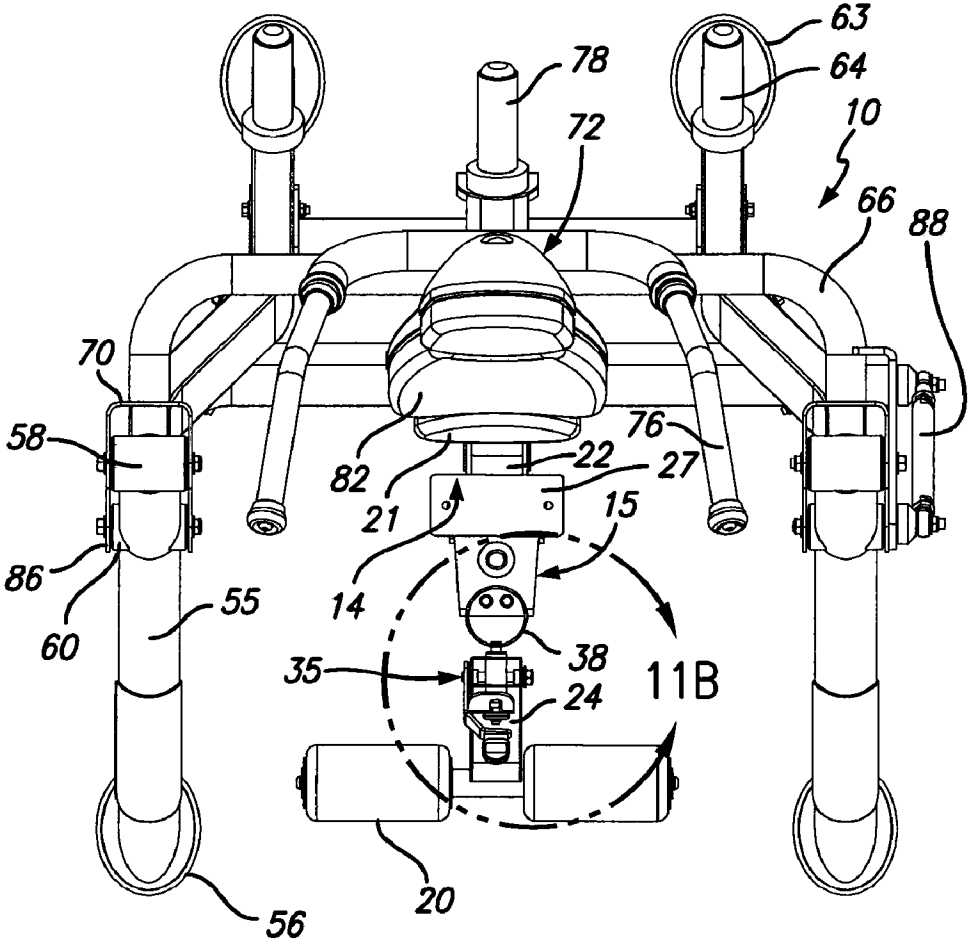
FIG. 11A is a top plan view of the machine similar to FIG. 8 but with the seat pad removed to reveal the centering device securing the user support in a centered, forward facing position.

When the user has finished performing exercises on the machine and wishes to exit the seat, they simply flip the pull pin actuator lever 42 back up, releasing the plunger 41 so that it extends as far as possible, based on the position of the seat relative to the pinning hole on the seat support frame 15. As best illustrated in FIGS. 5A and 10B, the plunger 41 of the pull pin makes contact with the curved ramping plate 38 at the forward end of the main arm 26 of the seat support frame when it is released into a deployed position with the seat swiveled to one side. The plunger is spring loaded in this position by the internal spring (not illustrated) of the pull pin 36. As the seat is swiveled from the position of FIG. 10A and 10B towards the center position of FIG. 11A and 11B, the plunger 41 is progressively depressed as it travels up ramping plate 38, increasing the spring force, until it is aligned with pull pin opening 40, at which point the spring tension propels the plunger 41 into the extended, fully deployed position engaging in the pinning hole 40 and locking the seat in a centered, forward facing position, as illustrated in FIGS. 4, 11A and 11B, allowing easier entry and exit by the user. This does not require any manipulation by the user to align the pull pin with the pinning opening. Instead, they simply slowly rotate the seat forwards until the pin or plunger engages automatically in the pinning hole.

FIGS. 14 to 18 illustrate a second embodiment of a swiveling exercise seat assembly 100 used on the same abdominal crunch exercise machine as in the previous embodiment, and like reference numerals are used for like parts of the exercise machine as appropriate. The only modifications in this embodiment are the centering device 110 and the location of the pivot mount 112 for the swiveling seat. The swiveling exercise seat assembly of FIGS. 14 to 18 is otherwise identical to the previous embodiment, and like reference numerals are used for like parts as appropriate.

Figure 17B:
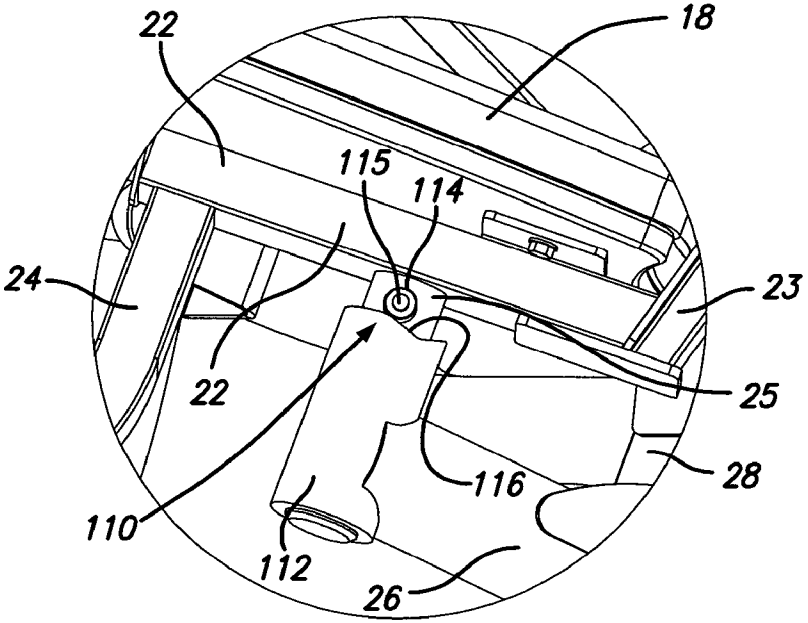
FIG. 17A and 17B are views similar to FIGS. 16A and 16B but with the machine in the exercise position.
Figure 18B:
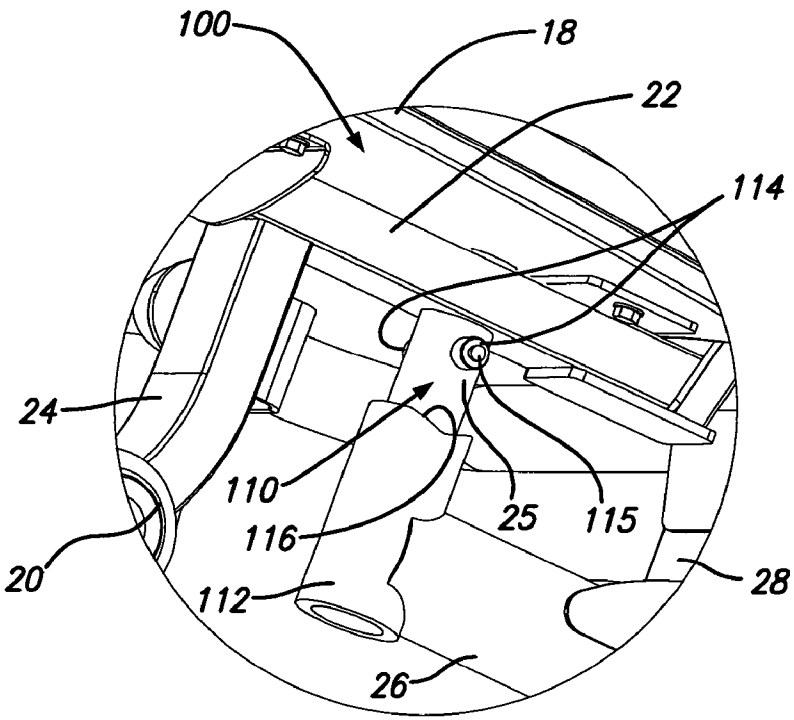
FIG. 18A and 18B are views similar to FIGS. 17A and 17B but with the user support assembly partially exploded and lifted out of the pivot mount on the seat support frame to illustrate parts of the centering device.
Figure 18A:
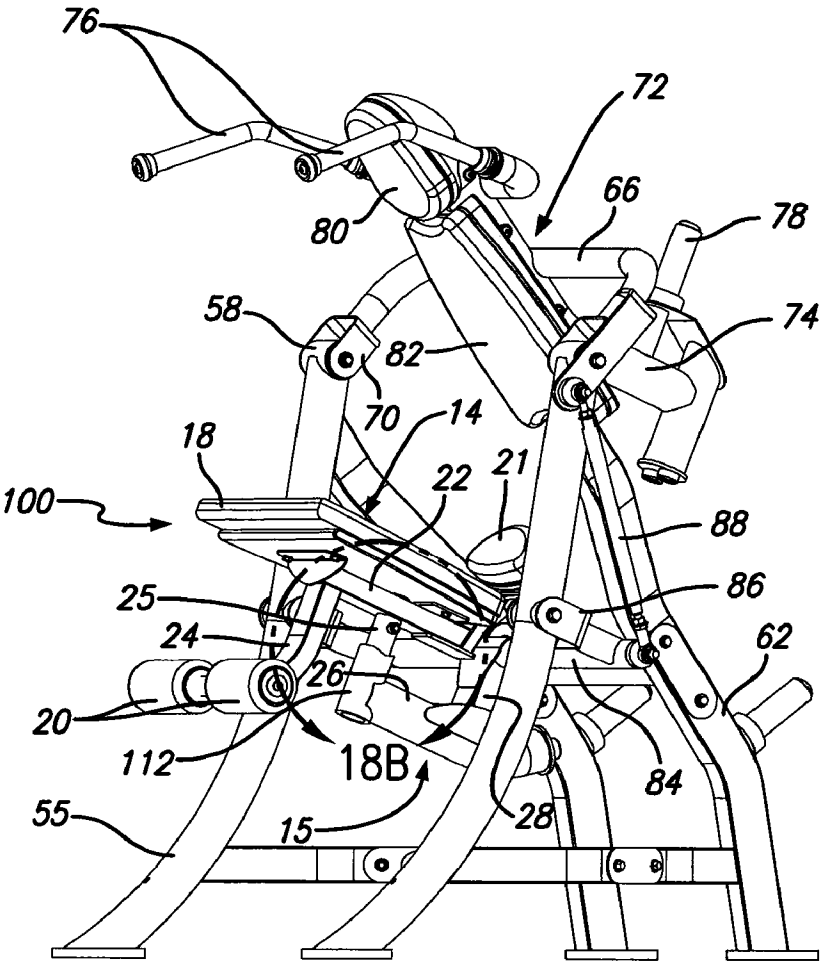

In this embodiment, the centering device is not mounted on the downwardly extending support member 24 of the user seat. Instead, rollers associated with the user support or seat 14 run on tracks or guides associated with the seat support frame 15 in order to urge the seat into a centered, forwardly facing position. As best illustrated in FIGS. 15B, 16B, 17B and 18B, the seat support frame in this embodiment has a user support pivot sleeve 112 mounted at the forward end of the main arm 26 of the user or seat support frame 15, and the user support pivot shaft 25 is rotatably mounted in sleeve 112. The centering device of this embodiment comprises ball bearing rollers or cam followers 114 mounted on the opposite ends of an axle 115 transversely mounted through the pivot shaft 25, and a V-shaped top edge indent or guide track 116 on each side of the pivot mount or pivot sleeve 112 of the seat support frame that receives pivot shaft 25. The cam followers 114 are received in the V-shaped guides when the shaft 25 is mounted in pivot mount or sleeve 112. In FIGS. 18A and 18B, the user support seat is lifted partially out of the pivot mount 112 on the seat support frame to better show the rollers 114 and the V-shaped indents 116 in the top edge of the pivot mount.

Figure 14:
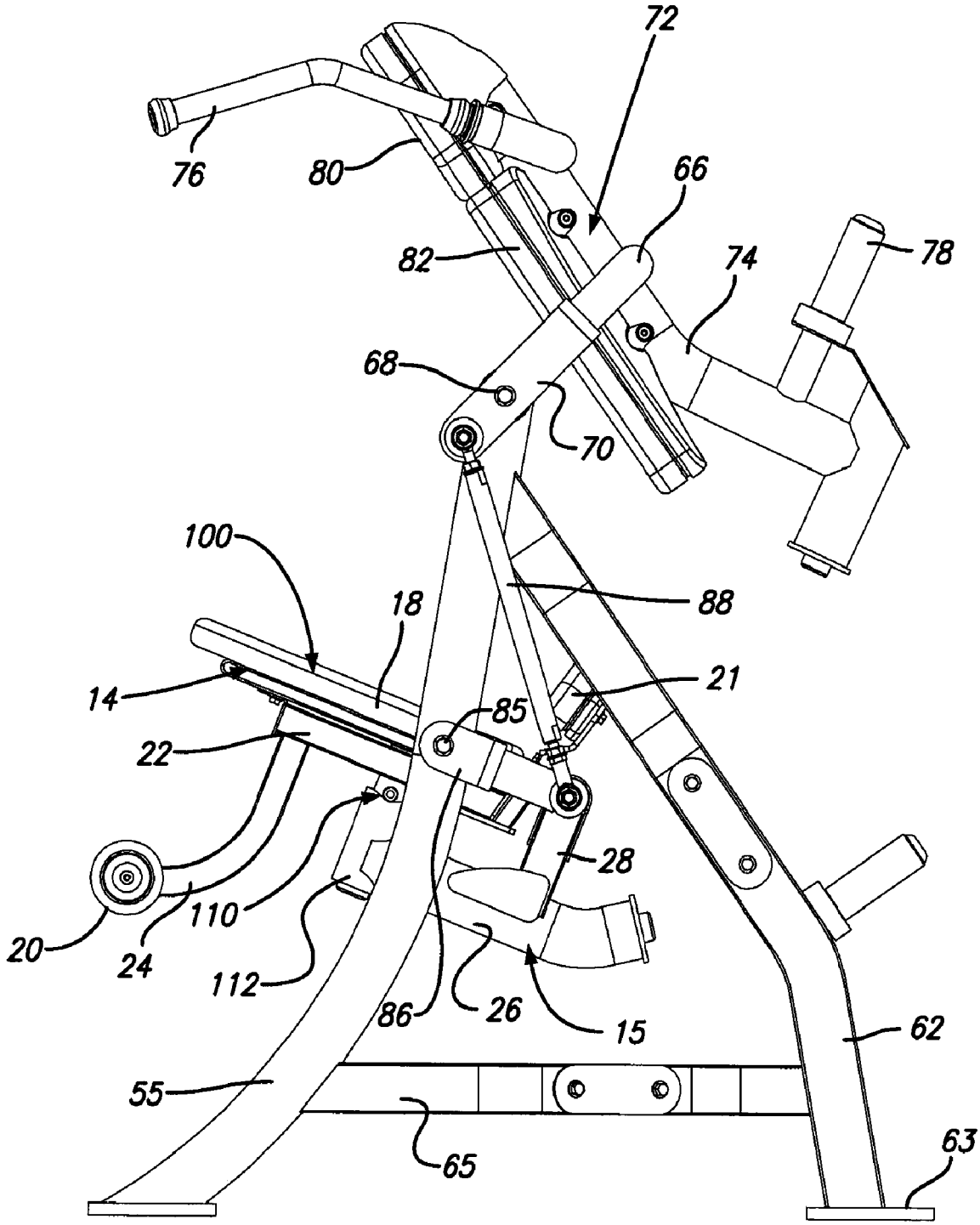
FIG. 14 is a side elevation view of an abdominal exercise machine including a second embodiment of a swiveling seat assembly, with the exercise machine in an exercise position in which the centering device is revealed.
Figure 15B:
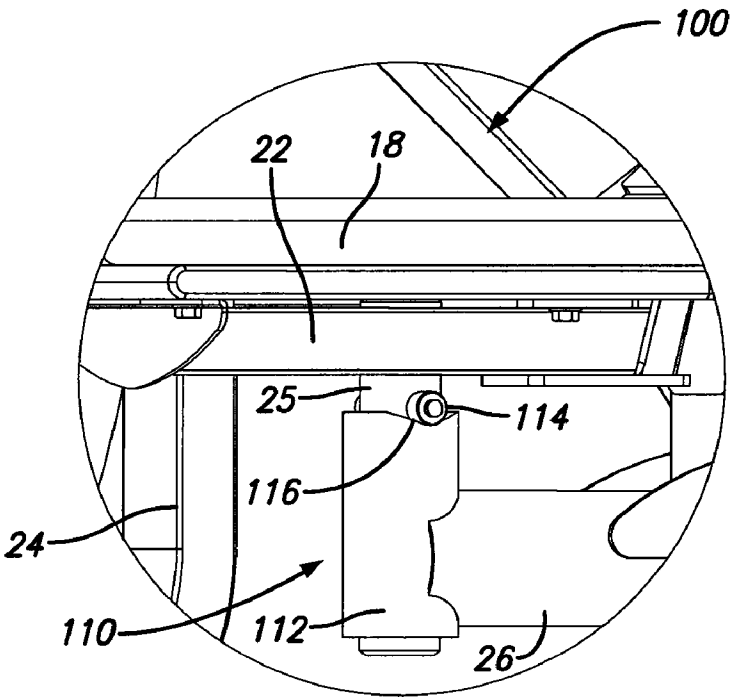
FIG. 15B is an enlarged view of circled area in FIG. 15A, with the centering device locking the user support in a centered, forward facing position.
Figure 15A:
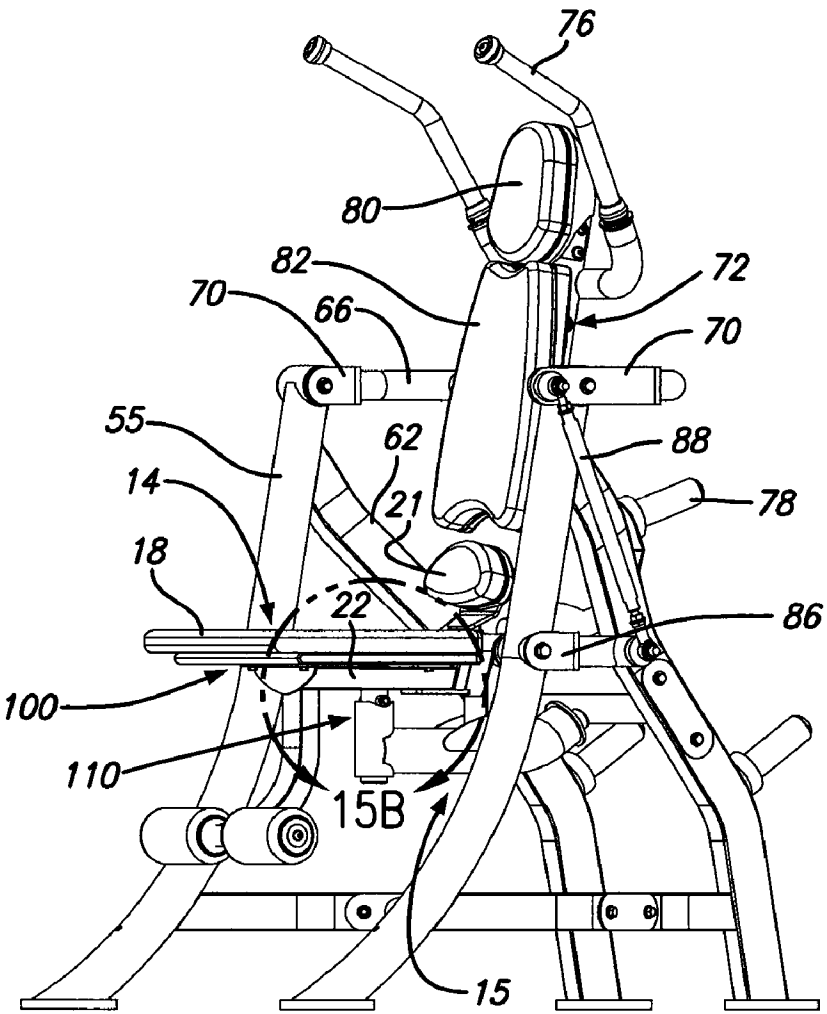
FIG. 15A is a front perspective view of the machine of FIG. 14 in an exercise start or rest position with the seat assembly in the centered, forward facing position.

FIG. 14 is a side view of the machine in an abdominal crunch exercise position, to better reveal the centering device. FIGS. 15A and 15B illustrate an exercise start position in which the user support assembly 100 is in a forward facing, centered orientation. In this position, the cam followers 114 are at the low point or apex of the V-shaped indents 116 in the top edge of the pivot mount 112, as illustrated in FIG. 15B. This holds the seat in a stable position for user entry or exit, yet makes it easy for the user to swivel from side to side. As the seat is swiveled, the cam followers ride along the top edge of the pivot mount, going up and down the sloped edges of the V-shaped indents.

Figure 16B:
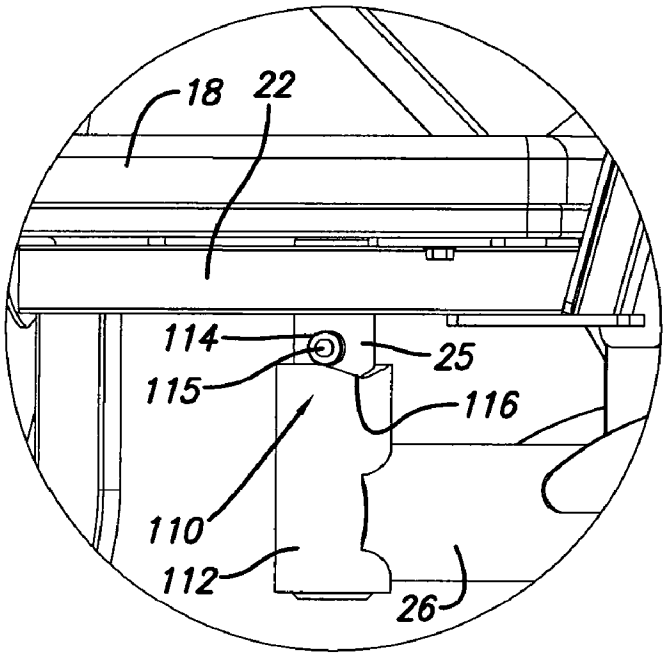
FIGS. 16A and 16B are views similar to FIGS. 15A and 15B but with the seat swiveled to one side to illustrate operation of the centering device.
Figure 16A:
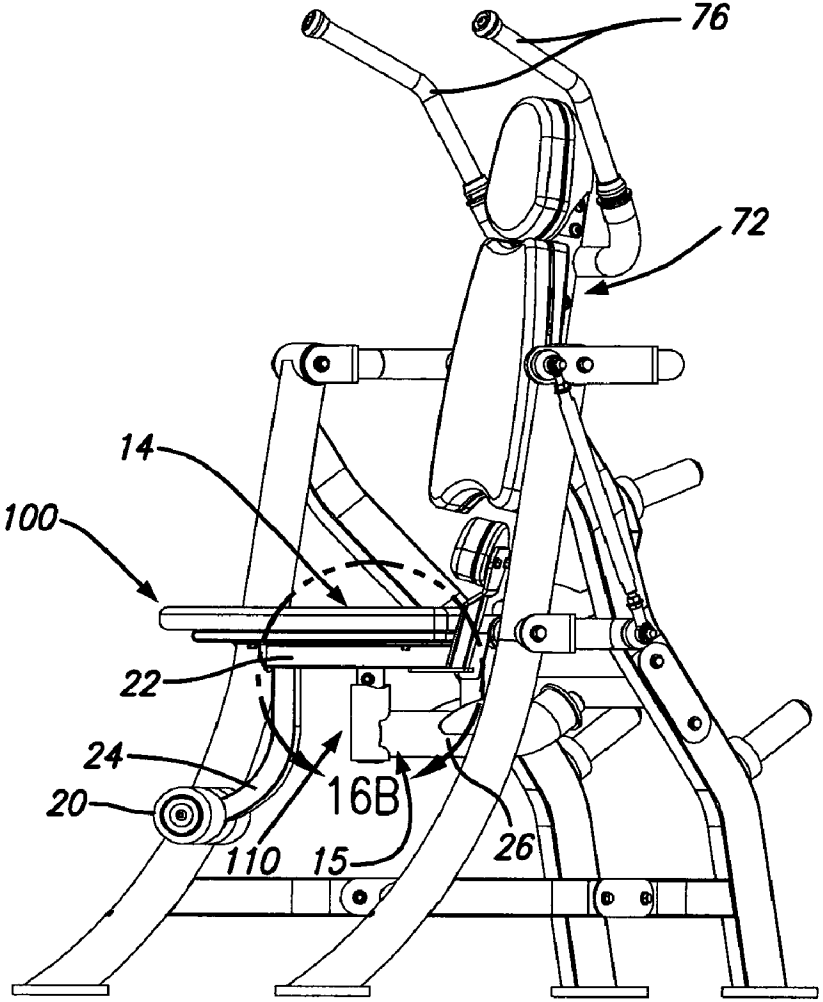
Figure 17A:
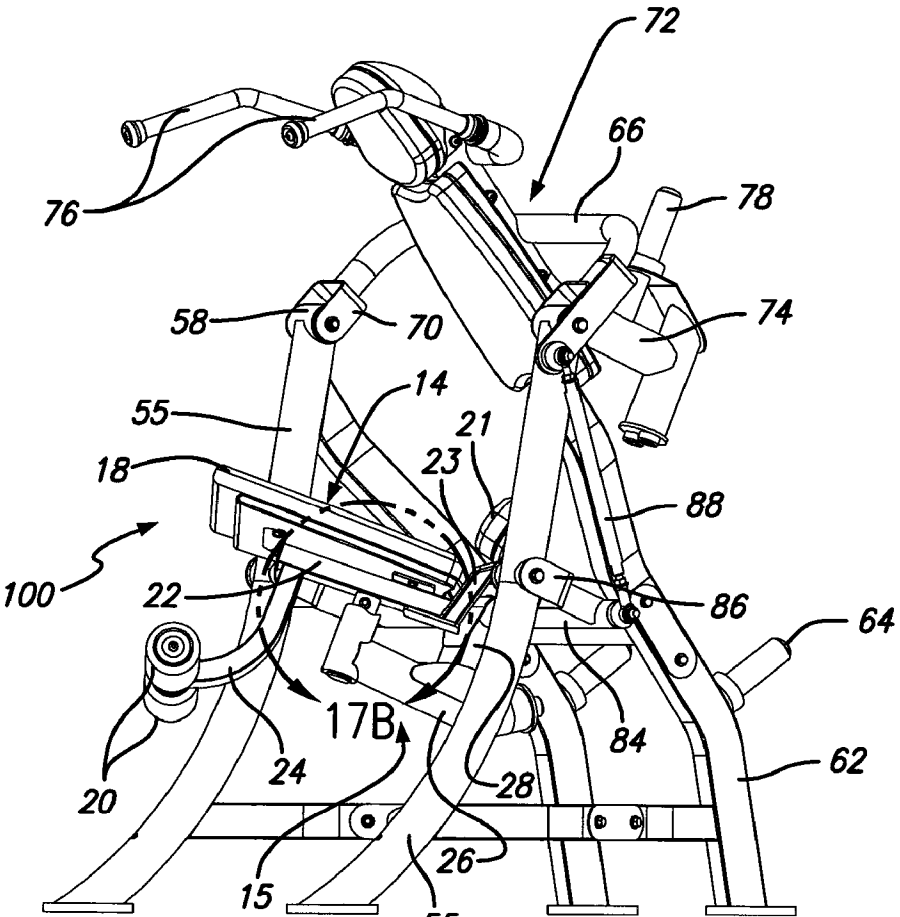

FIGS. 16A and 16B are similar to FIG. 15, and illustrate an exercise start position with the user support seat swiveled to one side, so that the cam followers or rollers 114 ride up the respective side edge of the V-shaped indents 116. FIGS. 17A and 17B are similar to FIGS. 16A and 16B, but with the machine in a finish position for an abdominal crunch exercise, i.e. similar to FIG. 14 but with the seat swiveled to one side rather than centered. FIGS. 18A and 18B illustrate the same position as FIG. 17, but with the user seat lifted partially out of pivot mount 112 to better illustrate rollers 114 and V-shaped indent 116. As in the previous embodiment, the user can choose to perform abdominal crunch exercises while swiveling the seat from side to side. The main difference is that the user does not have to move any actuating lever in order to engage or disengage the centering device. If the user swivels to one side and then relaxes, the seat tends to automatically move back to a centered, forward facing position since the rollers are biased downward by gravity and tend to glide down to the lowest point of each V-shaped indent 116. Because of the V-shape of the indent, core stabilizing muscles have to be employed by the user in order to hold the seat in any off-center, side-swiveled position.

Figure 19:
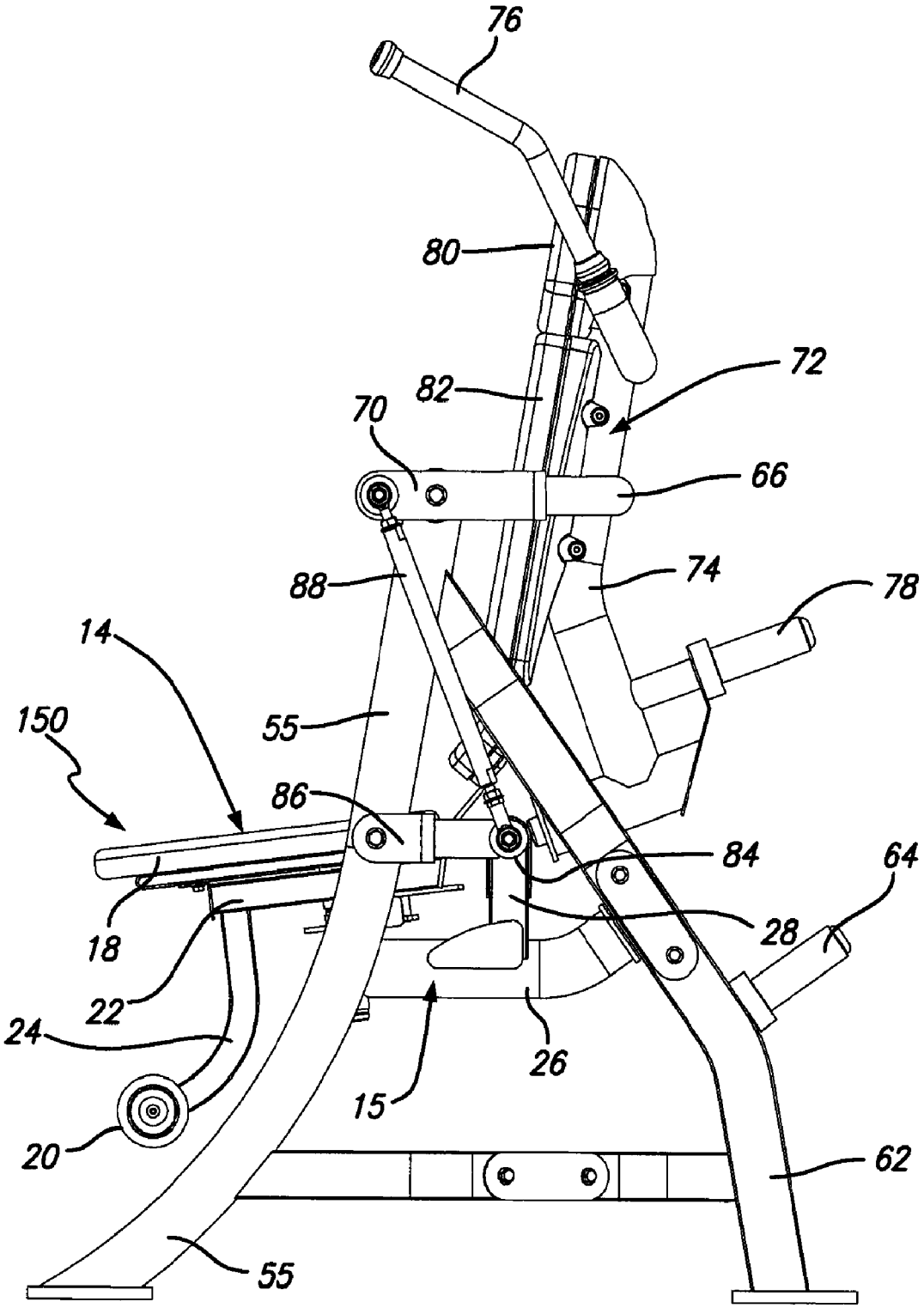
FIG. 19 is a side elevation view of an exercise machine including a third embodiment of a swiveling seat assembly, with the user support tilted at a downward angle.
Figure 20:
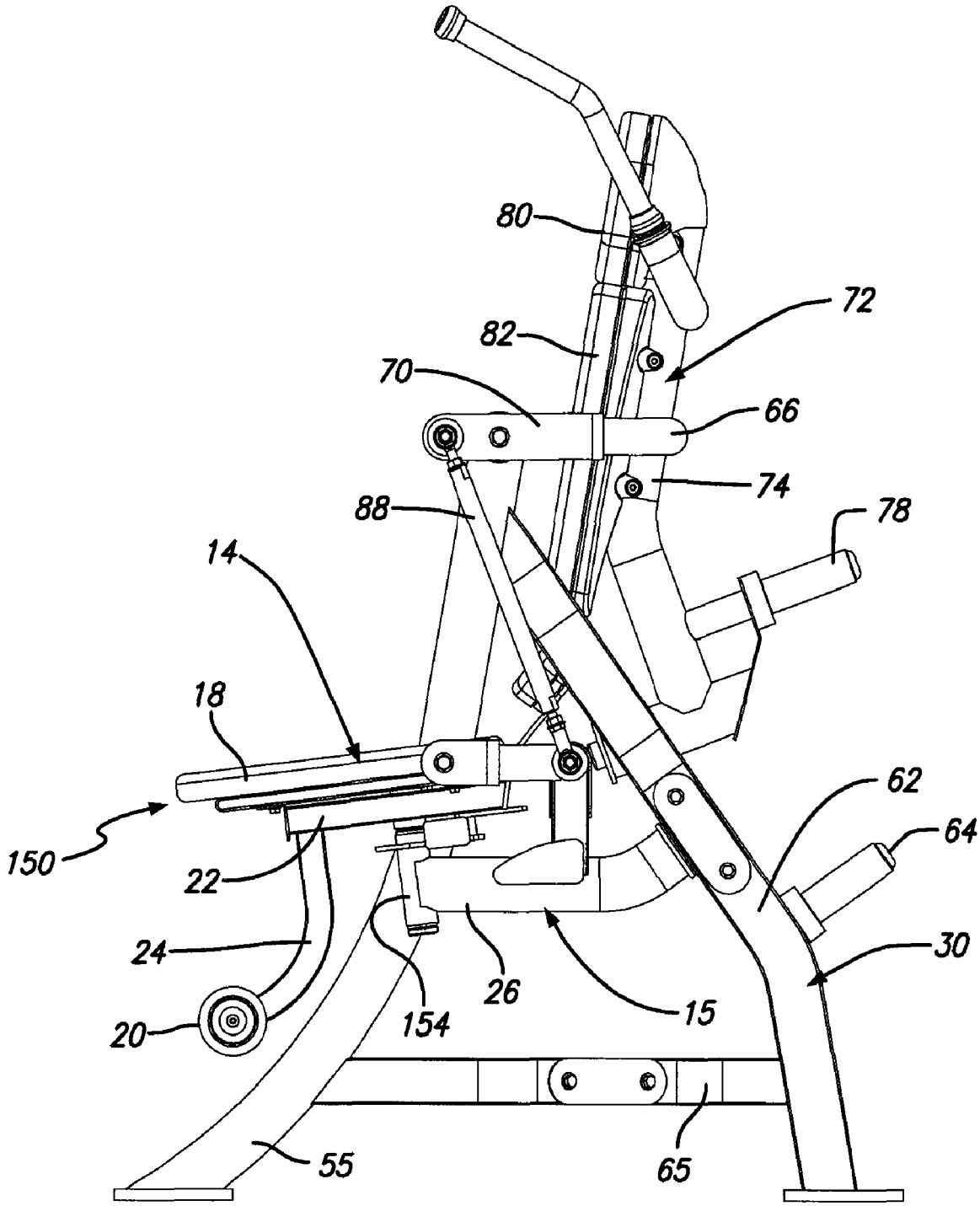
FIG. 20 is a side view of the machine similar to FIG. 19 but with parts of the machine framework removed to illustrate more details of the seat assembly.
Figure 21B:
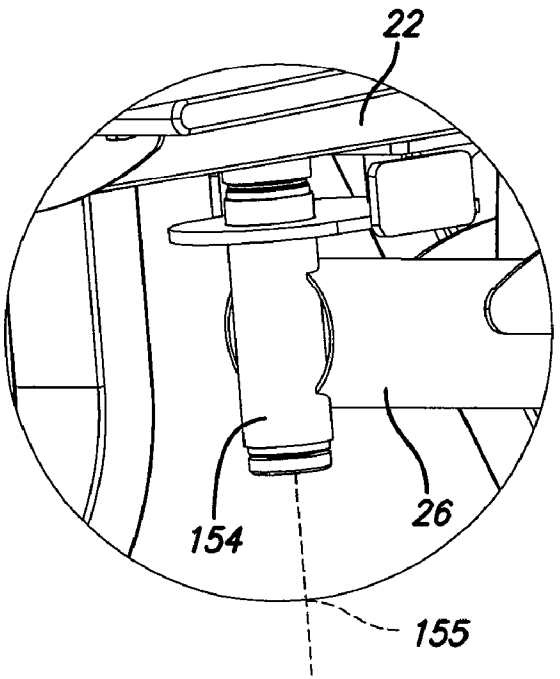
FIG. 21B is an enlarged view of the circled area in FIG. 21A.
Figure 21A:
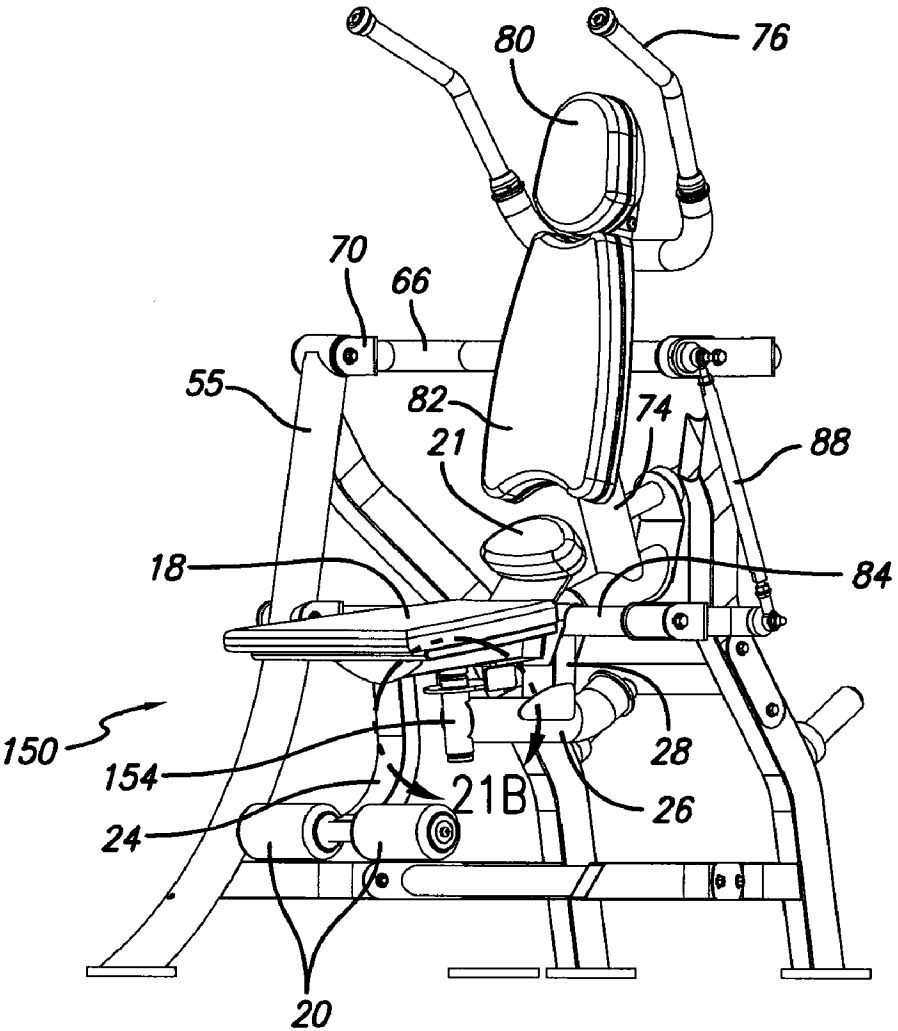
FIG. 21A is a front perspective view of the machine in a start position with the user support in a centered, forward facing orientation.

FIGS. 19 to 22 illustrate a third embodiment of a swiveling exercise seat assembly 150 used on the same abdominal crunch exercise machine as in the previous embodiments, and like reference numerals are used for like parts of the exercise machine as appropriate. All features and framework of the swiveling exercise seat assembly are identical to the previous embodiments, apart from the pivot mounting of the user seat 14 on the seat support frame 15 and the seat centering arrangement, and like reference numerals are used for like parts of the swiveling seat assembly as appropriate. Unlike the previous embodiments, where the user seat swiveled about a pivot axis 75 which was generally vertical in start position for an abdominal crunch exercise, in this embodiment the pivot mount 154 on the main arm 26 of the seat support frame 15 is mounted at a slight forward angle, as best seen in FIGS. 20 to 22, rather than in a vertical starting orientation as in the previous embodiments. The user seat pivot axle 25 engages in angled pivot mount 154 for rotation about inclined pivot axis 155 (see FIG. 21A). Pivot axis 155 still extends perpendicular to the swiveling seat pad 18 and the base tube 22 of the user support seat, as in the previous embodiments. The angled mounting of the user support places the user support assembly, and the seat pad 18 on which the user sits, in a downward tilt or decline as illustrated in FIGS. 19 and 20 when in the starting or rest position.

Figure 22B:
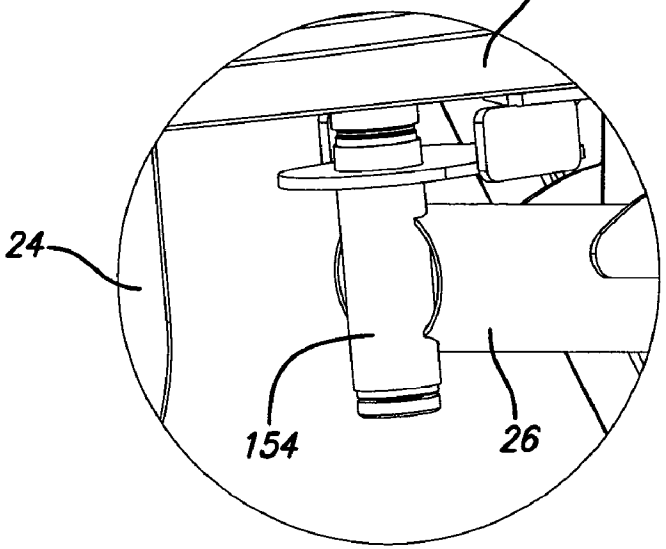
FIG. 22A and 22B are views similar to FIG. 21A and 21B but with the seat swiveled to one side.
Figure 22A:
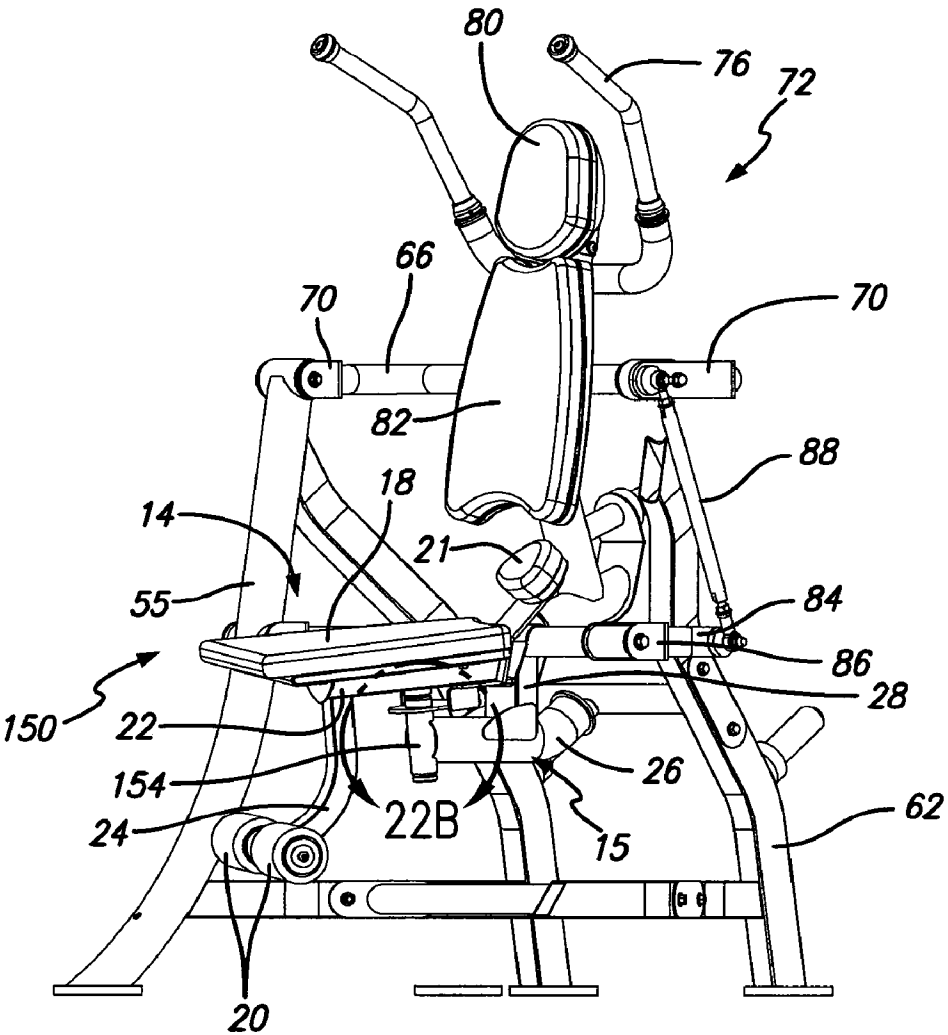

FIG. 19 illustrates the exercise machine in the start position, while FIG. 20 is the same view as FIG. 19 but with part of the main frame of the machine removed (specifically main or front upright 55), so that the user seat and seat support frame can be seen more clearly. FIGS. 21A and 22A also have the same part of the frame removed, with FIGS. 21A and 21B illustrating the start position of the user seat, and FIGS. 22A and 22B illustrating the seat swiveled to one side. In this embodiment, the angled pivot mounting of the user seat provides the centering mechanism, and no additional centering structure is required. The angled mounting places the user support assembly in a downward tilt or decline in the exercise start position, and this tilt, combined with the forward weight of the assembly, uses gravity to pull the seat towards its lowest position, which also happens to be the centered, forward facing position of FIGS. 19 to 21. This gravitational influence is increased by the weight of a seated user, yet makes it easy for the user to swivel unrestricted from side to side, since the seat is not locked in the central position.

It can be seen by comparison of FIGS. 21A and 22A that the seat must be swiveled uphill slightly when swiveling to one side from the centered position of FIG. 21A, due to the angled pivot mount. This in turn means that the seat tends to swivel back to the centered position due to gravity when released. Apart from the angled pivot axis which also provides the self-centering mechanism, operation of the swiveling seat assembly 150 of this embodiment is identical to the previous embodiment.

FIGS. 23 to 26 illustrate a fourth embodiment of a swiveling exercise seat assembly 160 used on the same abdominal crunch exercise machine as in the previous embodiment, and like reference numerals are used for like parts of the exercise machine as appropriate. In this embodiment, the user seat 162 and the seat support frame or mounting device 164 are modified, along with the pivot connection between these components and the centering device. However, some parts of the seat 162 and seat support frame 164 are identical to the previous embodiments, and like reference numerals are used for like parts as appropriate.

In this embodiment, the primary support or seat pad 18 and base frame member 22 which supports pad 18 are similar to the previous embodiments, as is the tail bone pad 21. However, the stabilizing rollers 20 of the previous embodiments are eliminated, and the downwardly extending support tube 165 of the base frame is extended, with a pair of foot plates 166 mounted on opposite sides at the lower end of support tube 165, as best illustrated in FIG. 24A. The foot plates 166 function in a similar manner to the roller pads 20 of the previous embodiments, aiding the user in controlling the swiveling of seat 162. As in the first embodiment, the swivel or pivotal connection between the seat 162 and the seat support frame 164 is provided by a pivot mount or sleeve 32 approximate the forward end of seat support tube 26 and a pivot axle (not visible in the drawings) which depends downwardly from the base member 22 of the seat 162 to engage in sleeve 32.

The centering mechanism in this embodiment is based on magnetic attraction, and comprises opposite polarity magnets 168, 170 mounted on the downwardly depending support tube 165 of the seat base frame and the forward end of the seat support tube 26 of the seat support frame, respectively, as best illustrated in FIGS. 23B, 24B, 25B and 26B.

Figure 23B:
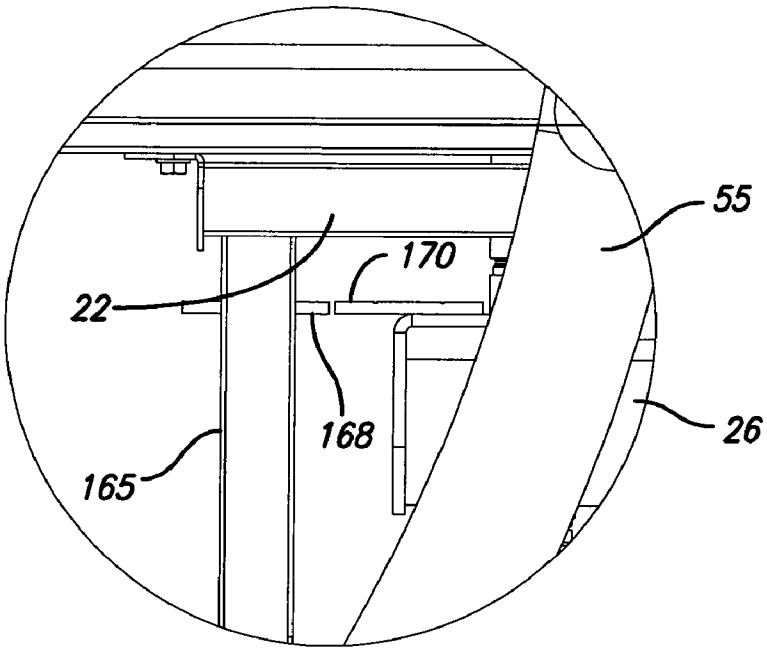
FIG. 23B is an enlarged view of circled region of FIG. 23A, illustrating part of the centering device of the seat assembly of FIG. 23A.
Figure 23A:
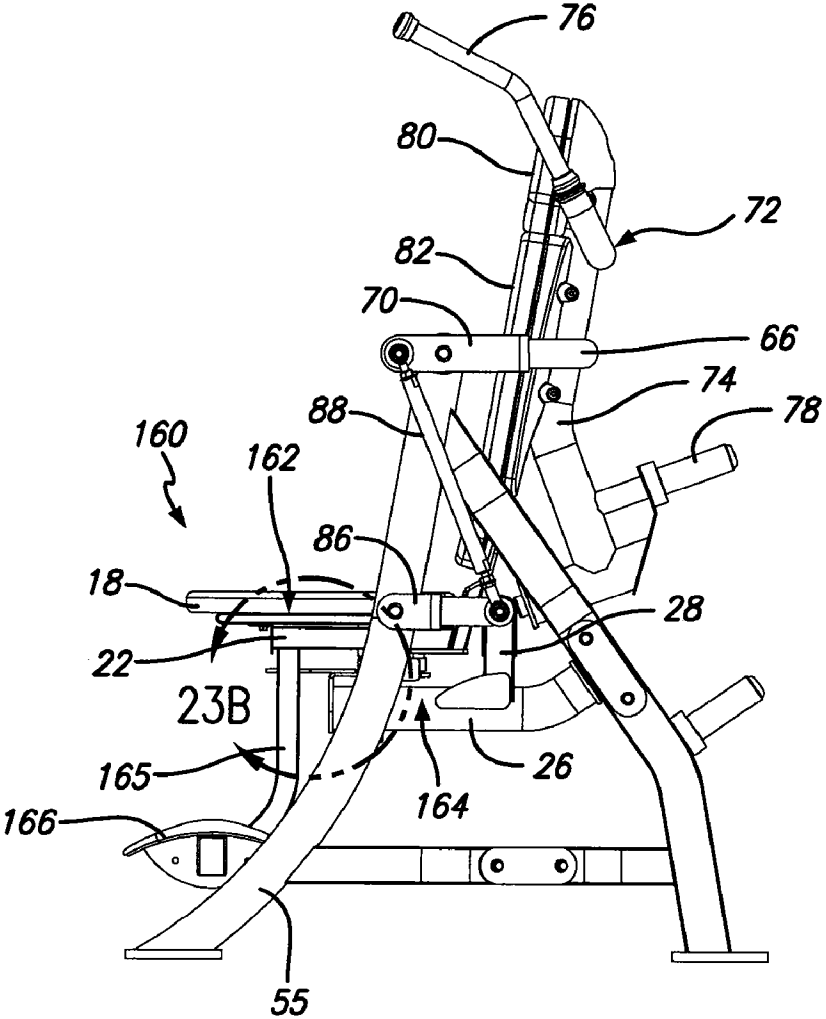
FIG. 23A is a side elevation view of an exercise machine including a fourth embodiment of a swiveling seat assembly, with the user support in a centered, forwardly facing position.
Figure 25B:
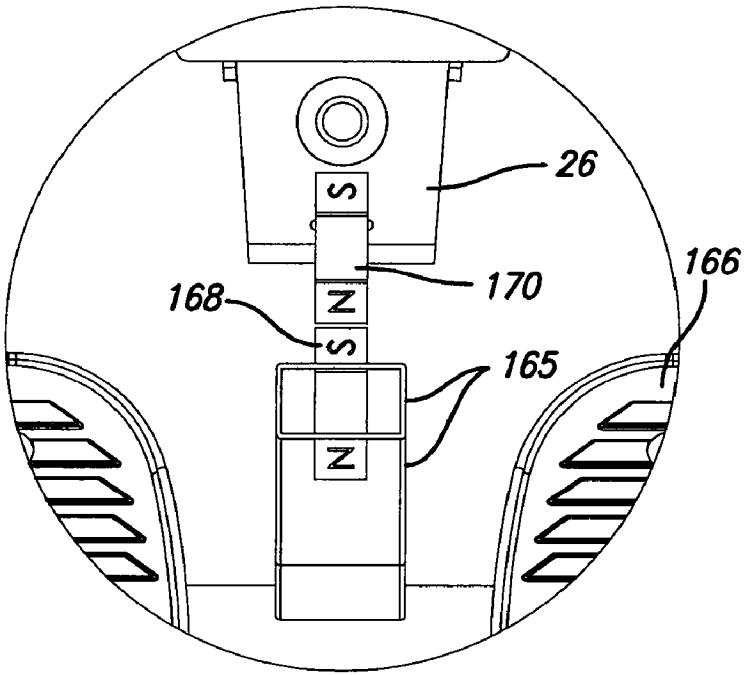
FIG. 25B is an enlarged view of the circled area of FIG. 25A.
Figure 25A:
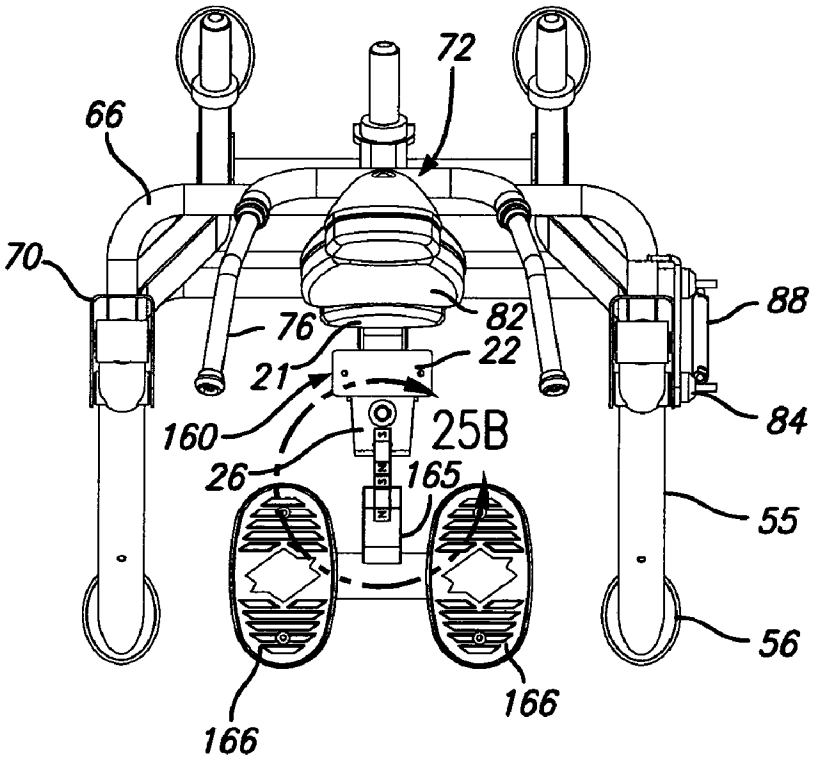
FIG. 25A is a top plan view of the machine of FIG. 23A with the user seat centered and the seat pad removed to illustrate the centering device more clearly.

FIG. 23A illustrates a side view of the exercise machine with the seat 162 in the centered, start or rest position, while FIG. 25A is a top plan view of the machine in the same position but with the seat pad 18 and part of the base frame 22 removed to reveal the centering or alignment mechanism. As illustrated in the expanded views of FIGS. 23B and 25B, the magnets 168 and 170 are aligned in this position with the opposite poles adjacent one another. The attraction between the magnets is strongest in this position, helping to hold the seat in a centered, stable position for user exit and entry, yet making it easy for the user to swivel from side to side.

Figure 24B:
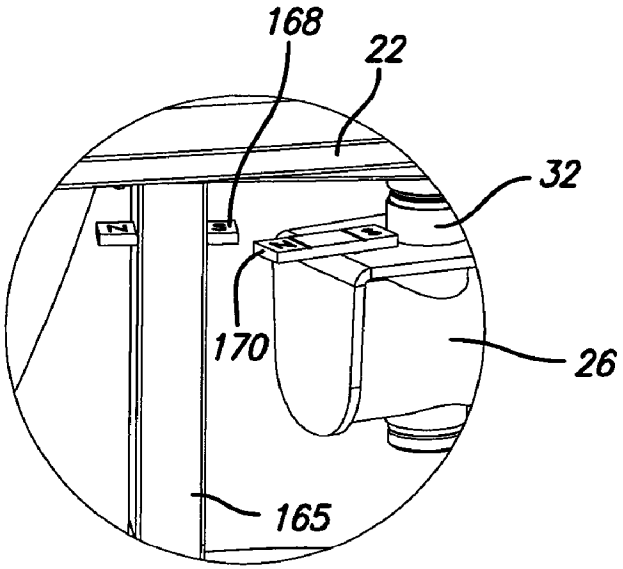
FIG. 24B is an enlarged view of the circled area in FIG. 24A.
Figure 24A:
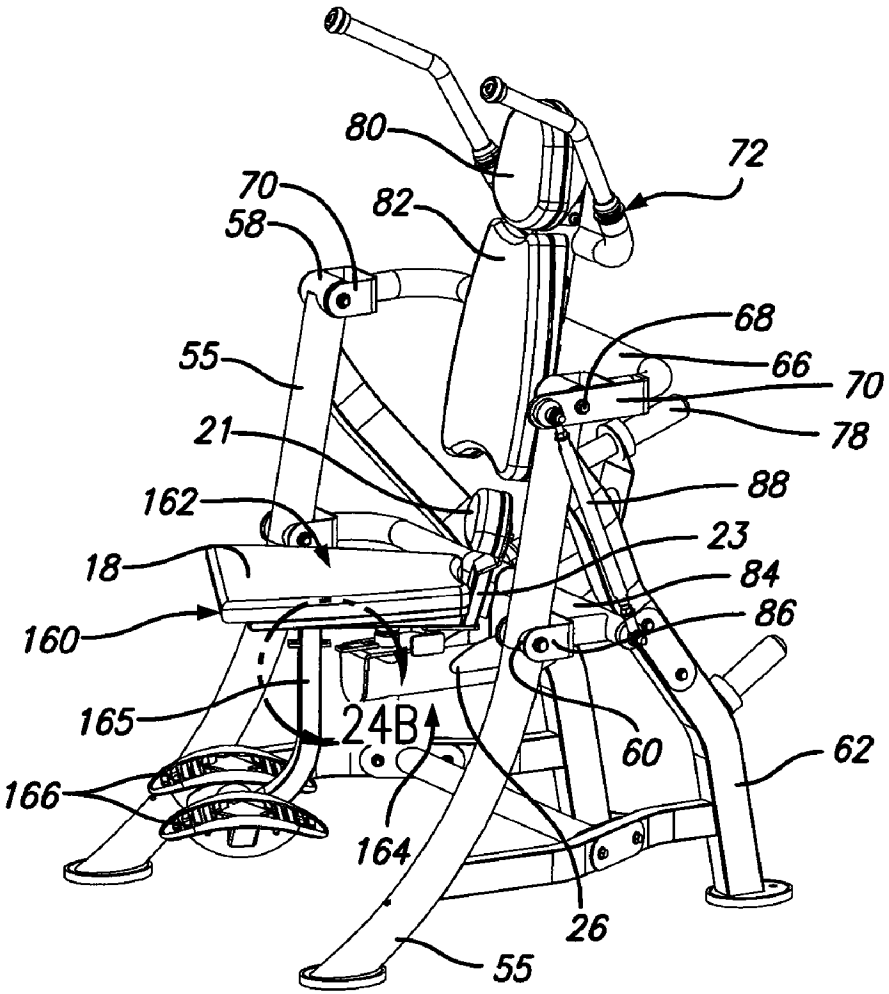
FIG. 24A is a side perspective view of the machine of FIG. 23A with the seat swiveled to one side.
Figure 26B:
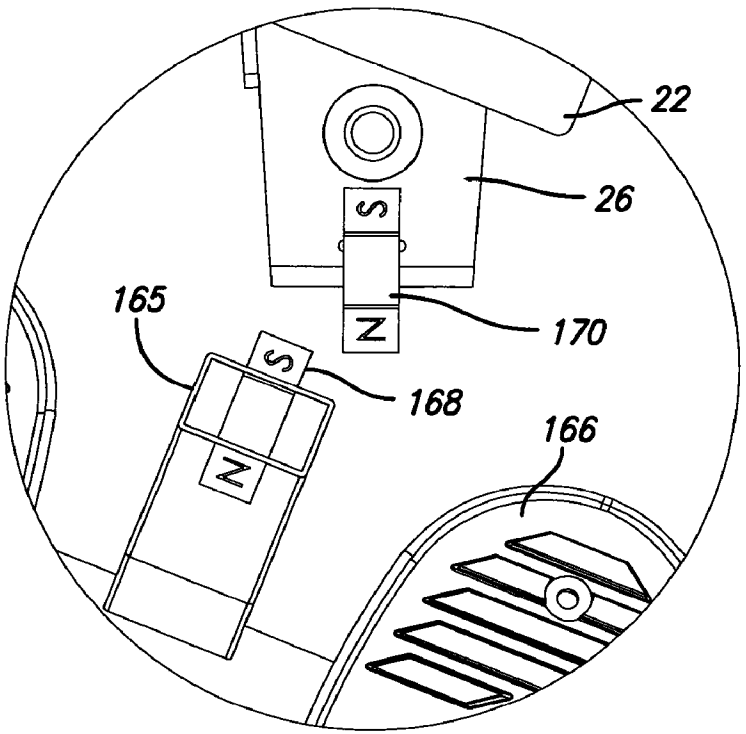
FIG. 26B is an enlarged view of the circled area of FIG. 26A.
Figure 26A:
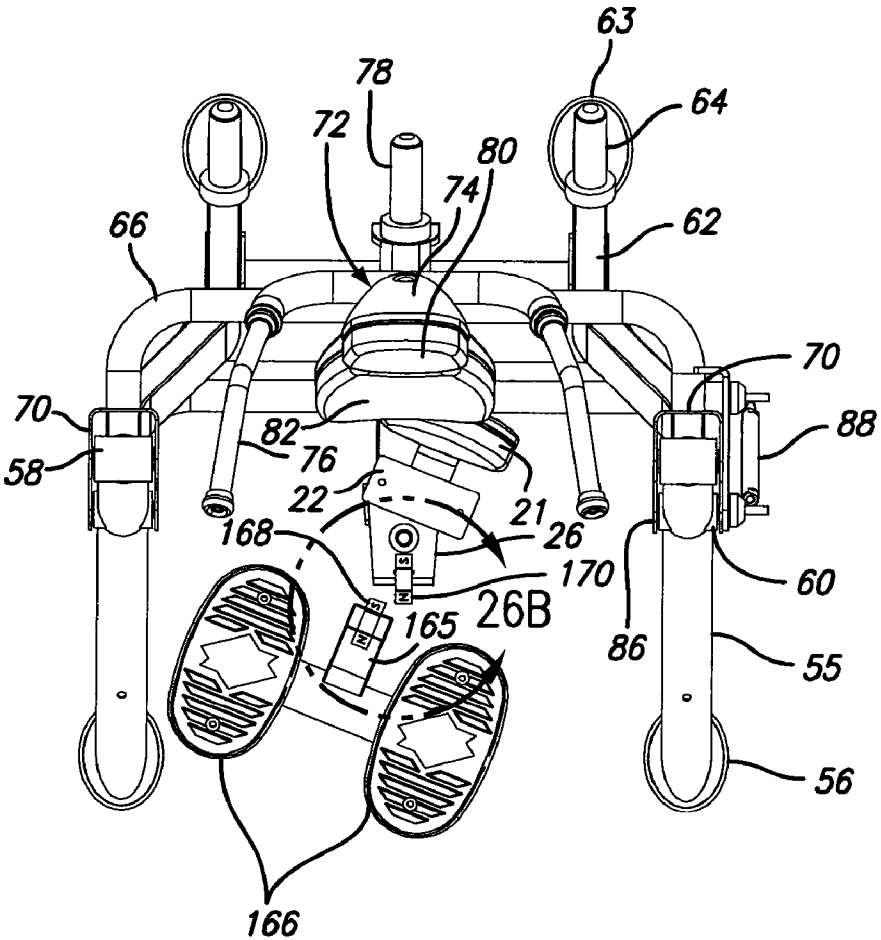
FIGS. 26A is a top plan view similar to FIG. 25A, with the user seat in the swiveled position of FIG. 24A and the seat pad removed.

When a user is seated on seat 162, they can swivel the seat from side to side about the pivot connection at pivot sleeve 32, overcoming the magnetic field attraction between the opposite poles of magnets 168, 170 and moving the magnets apart, as illustrated in FIGS. 24 and 26 where the seat is swiveled to one side. FIG. 24A is a perspective view of a side swiveled position of the seat, while FIG. 24B is an enlarged view of the circled portion of the seat assembly, illustrating the positions of the two magnets. FIG. 26A is a top plan view of the machine with the seat in the same position as FIG. 24A, and the seat pad removed to reveal the relative positions of the magnets. It can be seen that the magnet 168 on the support tube 165 of the seat base frame is moved to one side, away from the magnet 170 on the seat support frame on which the seat is pivoted.

Figure 27B:
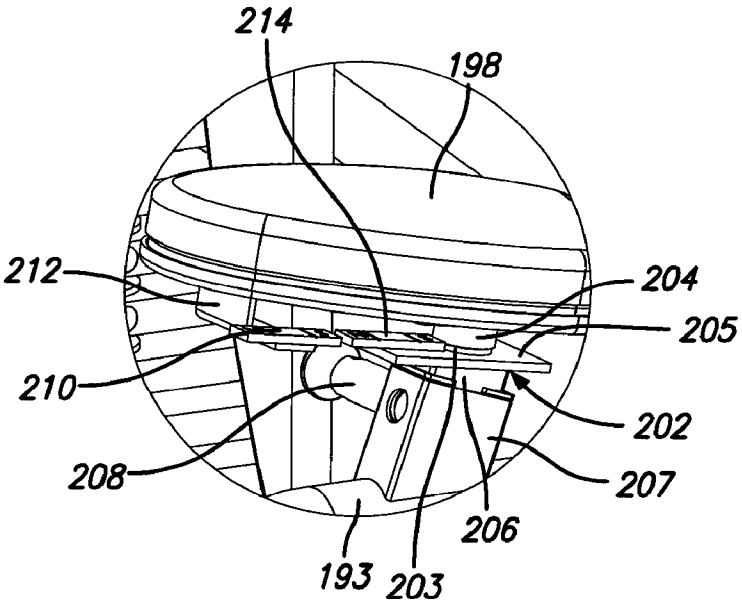
FIG. 27B is an enlarged view of the circled area of FIG. 27A.
Figure 27A:
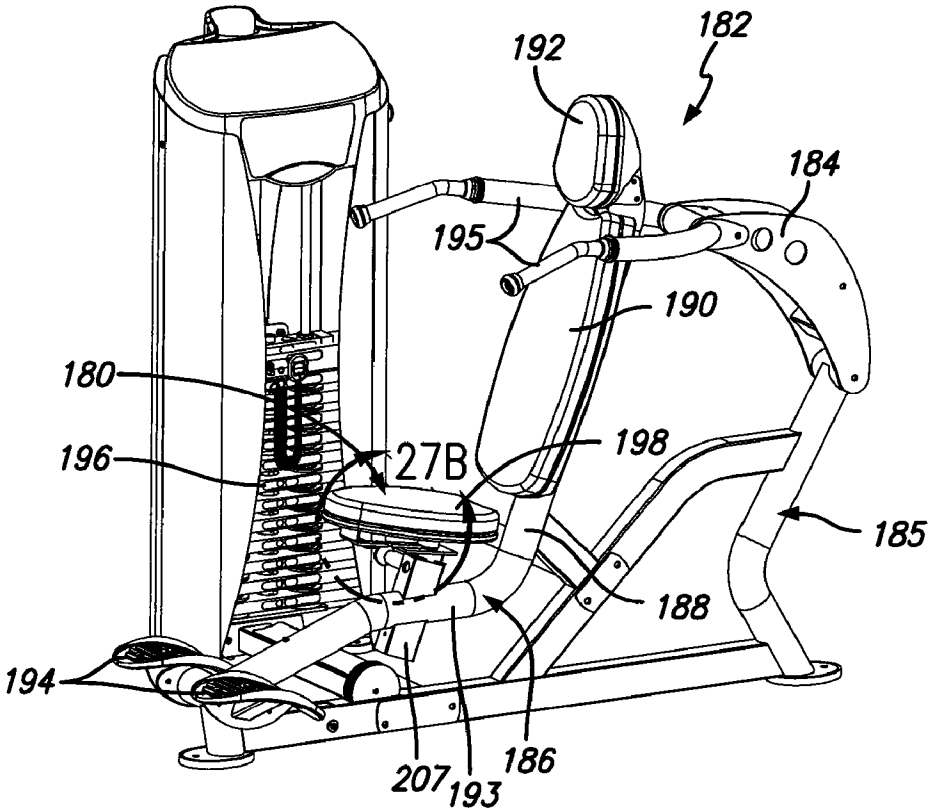
FIG. 27A is a side perspective view of a shoulder press exercise machine incorporating a modified version of the swiveling seat assembly, with the user support in a centered, forward facing orientation.
Figure 28:
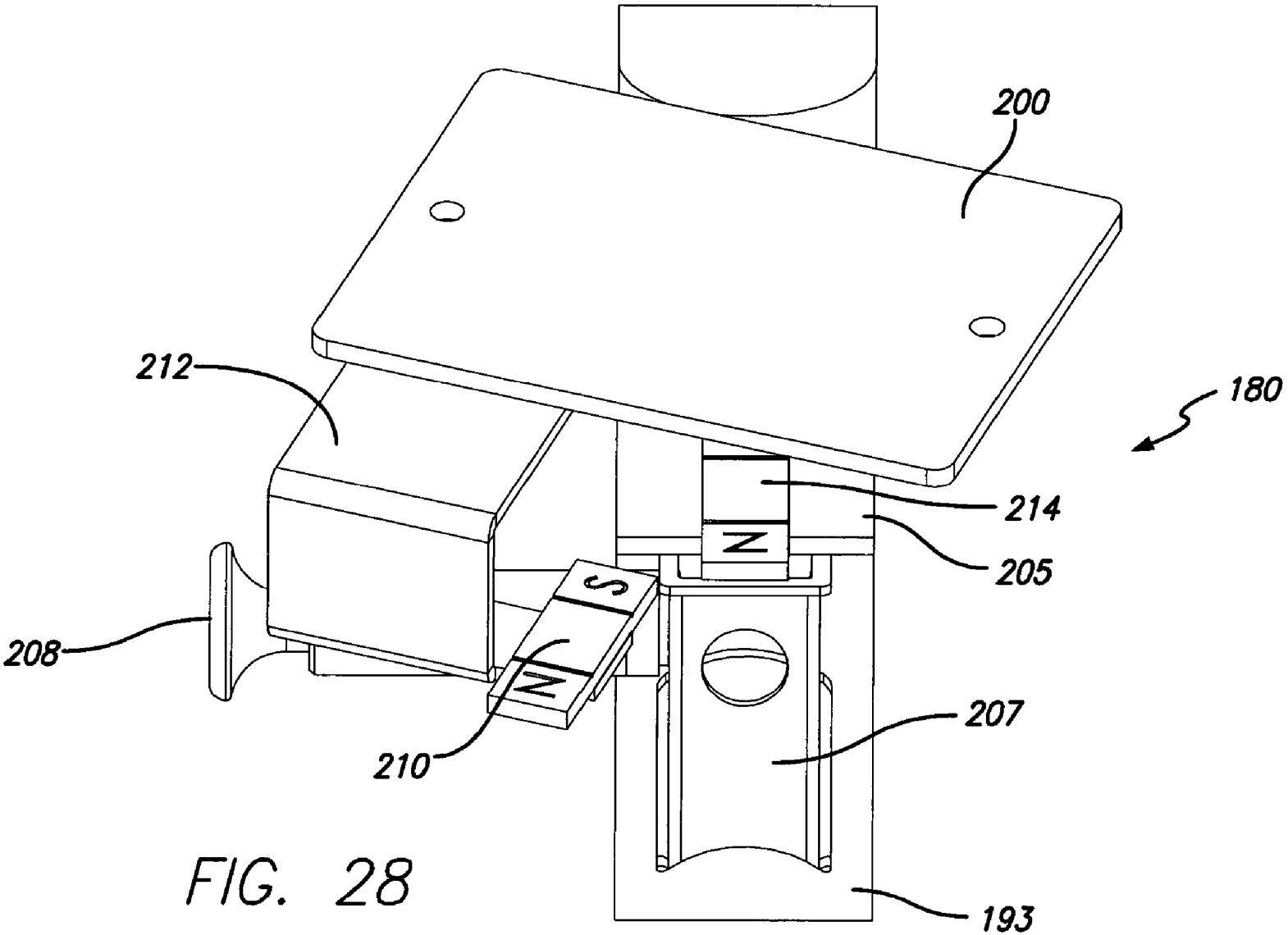
FIG. 28 is an enlarged top plan view of the seat assembly of FIG. 27 with the seat pad removed and the base plate swiveled to one side.

FIGS. 27 and 28 illustrate another embodiment of a swiveling user seat assembly 180 mounted on a different exercise machine from the previous embodiments, in this case a shoulder press exercise machine 182. Machine 182 has a shoulder press exercise arm 184 pivotally mounted on a main frame 185 of the machine to the rear of a user support having a seat support frame or mounting device 186 which is rigidly mounted on the main frame, or may alternatively be pivotally mounted on the main frame for rotation about a horizontal axis between forwardly tilted and rearwardly reclined positions. In the latter case, movement of seat mounting device 186 may be linked to movement of the shoulder press exercise arm. The mounting device 186 comprises a generally L-shaped base member or strut with an upright portion 188 on which a forwardly facing back pad 190 and head pad 192 are mounted, and a base portion 193 on which the swiveling user seat assembly 180 is mounted. Foot plates 194 are mounted at the forward end of the base portion 193. Handle arms 195 project forwardly from exercise arm 184 on opposite sides of the upper portion of back pad 190. Exercise resistance is provided by a selectorized weight stack 196 mounted to one side of the main frame and linked to the exercise arm by a cable and pulley assembly in a manner generally known in the field.

In this embodiment, the swiveling user seat assembly 180 comprises a user seat having a seat pad 198 and a base plate 200. A pivotal connection is provided between the user seat and seat mounting device 186, as in the previous embodiments. In this embodiment, one part of the pivotal connection comprises a pivot mount 202, which is supported on base portion 193 of the seat support frame 186. Pivot mount 202 comprises a pivot sleeve 204 projecting upwardly from plate 205, which is mounted at the upper end of support tube 206. Support tube 206 is telescopically mounted in the upper end of an adjuster tube 207 projecting upwardly from the base portion 193 of seat support member or frame 186. The height of seat pad 198 may be adjusted by retracting a pull pin 208 out of an aligned pinning hole (not visible) in the seat support tube 206, moving the seat up or down to the desired height, and then releasing the pull pin to engage a new pinning hole in tube 206 aligned with the pin in the new position. Pivot sleeve 204 rotatably receives a pivot shaft (not visible in the drawings) which extends downwardly from the base plate 200 of the user seat.

The centering mechanism in this embodiment is similar to that of FIGS. 23 to 26. A first magnet 210 is mounted on a bracket 212 which extends down from a forward end of the seat base plate 200, as best illustrated in FIG. 28, which is a top plan view of the assembly with the seat pad 198 removed to reveal this mechanism in more detail. A second magnet 214 is mounted on the pivot support plate 205 and is aligned with the first magnet 210 when the seat 180 is in a centered, forwardly facing position as in FIGS. 27A and 27B. Opposite poles of the magnets are adjacent one another in the centered position of FIG. 27B. As illustrated in FIG. 28, when the seat is swiveled to one side, magnet 210 is also swiveled away from the magnet 214 on the pivot mount.

As in the previous embodiment, the magnets 210, 214 are placed so that they are aligned and their attraction is strongest when the seat is in a centered, forwardly facing position for easy user entry and exit. At the same time, it is relatively easy for the user to swivel the seat from side to side and overcome the magnetic field.

Although the user support in the above embodiments comprises a swiveling seat which has a primary support which supports a user in a seated position, the swiveling user support in alternative embodiments may be designed to support a user in different exercise positions, such as a kneeling position or a prone position. In the latter cases, the user support has a primary support which comprises a knee pad, a chest pad, or a back pad.

In each of the above embodiments, the user support has a pivotal connection to a seat support frame or seat mounting device to allow free swiveling, side-to-side movement of the seat during an exercise. At the same time, a centering mechanism or device is provided which tends to hold the seat in a central, forwardly facing position for user entry or exit. In one embodiment, the seat is releasably locked in this position. In other embodiments, the seat is biased or urged into this position while the user can move the seat from the central position by applying a small force to overcome the centering force or attraction. The biasing or centering mechanism may be gravitational or magnetic force, as described above, or may comprise other suitable biasing mechanisms such as compression or torsion springs, elastomeric materials, or the like. The generally free-swiveling movement is controlled by the user. It allows the user to pivot the seat from side to side as the exercise arm is being pivoted, involving a greater number of torso muscles. Swiveling the knees to one side or the other involves the oblique muscles as well as the upper and lower abdominal muscles as well as core stabilizing muscles in the abdominal and low back. The end result is an exercise machine that utilizes both a resistive, load bearing movement and free swiveling, user defined movement.

In most of the embodiments, the seat designs work well in an exercise movement where the seat support frame is pivotally mounted to the main frame of an exercise machine while the seat in turn is pivoted to the seat support frame. However, any of the seat embodiments above can be adapted to other exercise movements where the seat support frame is rigidly mounted to an exercise machine frame. The exercise machine may be designed for performing abdominal crunch exercises, other abdominal exercises, shoulder press exercises, or may be designed for exercising other muscles in the upper body or the lower body. Regardless of the type of exercise being performed, the free swiveling seat additionally involves core stabilizing muscles in the abdominal and lower back area, achieving the benefit of exercising multiple muscle groups on one machine. Balancing on a moving seat and controlling its swiveling action requires core stabilizing muscles in the abdominal and low back area to become involved regardless of the type of exercise being performed.

It should be understood that all the different elements used in the various embodiments may be mixed and interchanged with one another. Any of the user support pads on the seat or exercise arm could be made adjustable; various types of user engaging handles could be used; the exercise arm could be unidirectional or bi-directional. The centering mechanism of any of the above embodiments may be used on any of the swiveling seat designs. The resistance may be associated with any of the moving parts in the above embodiments.

It should also be noted that different types and forms of components could be used in the above embodiments without affecting the scope of this invention. Cables could be replaced with belts, ropes, chains or the like, pulleys replaced with sprockets, and tubes could be replaced with solid rods or bars. Other types of resistance known to the art could by used for providing resistance to the main exercise performed, such as hydraulic, pneumatic, electro-magnetic or elastic band resistance devices.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a stationary main frame having a forward end, a rear end, and opposite sides;

a user support mounting device associated with the main frame;

a user support which is adapted to support to user in an exercise position while performing an exercise;

a pivotal connection between the user support and the user support mounting device which defines a user support pivot axis which permits free swiveling of the user support relative to the user support mounting device during an exercise at least through arcuate paths on each side of a central, forward facing, position of the user support, whereby rotation of the user support about the user support pivot axis during an exercise comprises a user-controlled swivel movement;

a user engagement device movably associated with one of the main frame, user support, and user support mounting device which is configured for engagement by a user to perform an exercise while positioned on the free swiveling user support;

a centering device between the user support mounting device and user support which releasably holds the user support in the central, forward facing position, the centering device comprising first and second parts, one of the parts being located on the user support and the other part being located on the user support mounting device;

the first part of the centering device comprising a releasable locking device and the second part having a central opening for releasably receiving the locking device when the user support is in the central position, the locking device including a biasing mechanism for biasing the locking device into the opening when the user support is in the central, forward facing position; and the second part of the centering device having ramp surfaces on each side of the central opening which urge the locking device towards a retracted, spring biased position as the user support is rotated in either direction towards the central position, whereby the retracted locking device is biased outwardly to spring into engagement with the central opening when the user support reaches the central, forward facing position.

2. An exercise machine, comprising;

a stationary main frame having a forward end, a rear end, and opposite sides;

a user support mounting device associated with the main frame;

a user support which is adapted to support a user in an exercise position while performing an exercise;

a pivotal connection between the user support and the user support mounting device which defines a user support pivot axis which permits the swiveling of the user support relative to the user support mounting device during an exercise at least through arcuate paths on each side of a central, forward facing position of the user support, whereby rotation of the user support about the user support pivot axis during an exercise comprises a user-controlled swivel movement; and a user engagement device movably associated with one of the main frame, user support, and user support mounting device which is configured for engagement by a user to perform an exercise while positioned on the free swiveling user support;

wherein the user support pivot axis is at a forward angle relative to the vertical orientation at least in the start position for an exercise, whereby the user support is tilted downwards towards the front of the main frame and is biased by gravity towards the central, forward facing position when swiveled in either direction away from the central position.

3. An exercise machine, comprising;

a stationary main frame having a forward end, a rear end, and opposite sides;

a user support mounting device associated with the main frame:

a user support which is adapted to support a user in an exercise position while performing an exercise;

a pivotal connection between the user support and the user support mounting device which defines a user support pivot axis which permits free swiveling of the user support relative to the user support mounting device during an exercise at least through arcuate paths on each side of a central, forward facing position of the user support, whereby rotation of the user support about the user support pivot axis during an exercise comprises a user-controlled swivel movement, wherein the user support pivot axis is vertical at least in the start position of an exercise; and a user engagement device movably associate with one of the main frame, user support, and user support mounting device with is configured for engagement by a user to perform an exercise while positioned on the swiveling user support.

4. The machine of claim 3, further comprising a centering device between the user support mounting device and user support which releasably holds the user support in the central, forward facing position.

5. The machine of claim 4, wherein the centering device comprises first and second parts, one of the parts being located on the user support and the other part being located on the user support mounting device.

6. The machine of claim 5, wherein the first part comprises a releasable locking device and the second part has a central opening for releasably receiving the locking device when the user support is in the central position, the locking device including a biasing mechanism for biasing the locking device into the opening when the user support is in the central, forward facing position.

7. The machine of claim 6, wherein the centering device further comprises a manually operable actuator movable between a first, inoperative position and a second, operative position in which the actuator holds the locking device in a retracted position, the user support swiveling freely through the central position when the locking device is held in the retracted position.

8. The machine of claim 5, wherein the first part comprises a track and the second part comprises at least one roller in rolling engagement with the track, and the track has a depression corresponding to the central, forward facing position of the user support, whereby the roller is biased by gravity towards the depression in the track and the user support is urged towards the central, forward facing position when swiveled in either direction away from the central position, and the user support returns to the central, forward facing position when not urged away from the central position by a user positioned on the user support.

9. The machine of claim 8, wherein the pivotal connection comprises a sleeve projecting upwardly from the use support mounting device and a shall projecting downward from the user support and pivotally engaged in the sleeve, the track comprises a V-shaped edge at the upper end of the sleeve, and the roller is mounted on an axle extending through the pivot shaft.

10. The machine of claim 5, wherein the first and second parts comprise magnets which bias the user support towards the central position by magnetic attraction.

11. The machine of claim 3, wherein the user support mounting device is rigidly mounted on the main frame.

12. The machine of claim 3, wherein the user support mounting device is pivotally mounted on the main frame for rotation about a second pivot axis which extends at an angle to the user support pivot axis.

13. The machine of claim 12, wherein the second pivot axis extends non-parallel to the user support pivot axis.

14. The machine of claim 12, further comprising a connecting link associated with the user engagement device which translates movement of the user engagement device into movement of the user support mounting device and user support about the second pivot axis in an exercise movement between exercise start and end positions.

15. The machine of claim 14, wherein the user support is freely rotatable about said user support pivot axis throughout the exercise movement.

16. The machine of claim 3, further comprising at least one stabilizing support associated with one of the user support mounting device, user support, and main frame which is adapted to support a different part of the user's body from the user support during an exercise.

17. The machine of claim 16, wherein the stabilizing support is associated with the user support and swivels with the user support when the user support is rotated about said seat pivot axis.

18. The machine of claim 16, wherein the stabilizing support is associated with the user support mounting device.

19. The machine of claim 16, wherein the stabilizing support is adapted to stabalize the user's legs during an exercise.

20. The machine of claim 16, further comprising a second stabilizing support which is adapted to support a different part of the user's body.

21. The machine of claim 20, wherein at least one of the stabilizing supports is associated, with the user support and swivels together with the user support.

22. The machine of claim 21, wherein both stabilizing supports are associated with the user support and swivel together with the user support.

23. The machine of claim 21, wherein the user support comprises a base and a seat pad mounted on the base which comprises the primary support for supporting a user in a seated position on the user support, and said one stabilizing support comprises a tail bone pad mounted on the base to the rear of the seat pad, the tail one pad and seat pad rotating together about said seat pivot axis.

24. The machine of claim 23, wherein the base has a forward portion which extends forward and downward from the seat pad, and the second stabilizing support is mounted on the forward portion of the base to rotate together with said seat and tail bone pads about said seat pivot axis.

25. The machine of claim 3, wherein the user support comprises a base member and a seat pad mounted on top of the base member and providing the primary support which is adapted to support a user in a seated position during an exercise, the pivotal connection comprising a first part projecting downward from the base member and a second part projecting upward from the user support mounting device and pivotally engaged with the first part.

26. The machine of claim 25, wherein one part of pivotal connection comprises a pivot sleeve and the other part comprises a pivot shaft rotatably engaged in the sleeve ,and the first and second parts are vertical in the start position of an exercise.

27. The machine of claim 25, further comprising a stabilizing support secured to the base member at a location spaced from the seat pad, the stabilizing support being adapted to support a different part of a user's body and rotating together with the seat pad about the user support pivot axis.

28. The machine of claim 27, wherein the stabilizing support is spaced forward from the seat pad and comprises at least one leg stabilizing device.

29. The machine of claim 27, wherein the stabilizing support is spaced rearward from the seat pad and comprises a support pad which is adapted to support at least part of a user's back.

30. The machine of claim 29, wherein the support pad comprises a tail bone pad.

31. An exercise machine, comprising:

a stationary main frame having a forward end, a rear end, and opposite sides;

a user support mounting, device associated with the main frame;

a user support which is adapted to support a user in an exercise position while performing an exercise;

a pivotal connection between the user support and the user support mounting device which defines a user support pivot axis which permits swiveling of the user support relative to the user support mounting, device during an exercise at least through arcuate paths on each side of a central, forward facing position of the user support, whereby rotation of the user support about the user support pivot axis comprises a user-controlled, pivoting movement throughout the exercise;

a centering mechanism which orients the user support in the central, forward facing position in a rest or exercise start position; and the pivotal connection comprising the centering mechanism and defining a user support pivot axis which is angled relative to the vertical axis of the main frame at least in the exercise start position, whereby the user support tilts downward in a direction towards the forward end of the frame in the exercise start position and is biased by gravity towards the central, forward facing position throughout an exercise.

32. The machine of claim 31, wherein the pivotal connection comprises first and second co-operating parts, one of the parts being located on the user support and the other part being located on the user support mounting device.

33. An exercise machine, comprising:

a stationary main frame having a forward end, a rear end and opposite sides;

a user support mounting device associated with the main frame;

a user support which is adapted to support a user in an exercise position while performing an exercise;

a pivotal connection between the user support and the user support mounting device which defines a user support pivot which permits swiveling of the user support relative to the user support mounting device during an exercise at least through arcuate paths on each side of a central, forward facing position of the user support, whereby rotation of the user support about the user support pivot axis comprises a user-controlled, pivoting movement throughout the exercise;

a centering mechanism which orients the user support in the central, forward facing position in a rest or exercise start position, the centering mechanism comprising first and second co-operating parts, one of the parts being located on the user support and the other part being located on the user support mounting device; and the first part comprising a track and the second part comprising at least one roller in rolling engagement with the track, the track having a depression corresponding to the central, forward facing position of the user support, whereby the roller is biased by gravity towards the depression in the track and the user support is urged towards the central, forward facing position when swiveled away from the central position, whereby the user support returns to the central, forward facing position when not in use.

34. An exercise machine, comprising:

a stationary main frame having a forward end, a rear end, and opposite sides;

a user support mounting device associated with the main frame;

a user support which is adapted to support a user in an exacts position while performing an exercise;

a pivotal connection between the user support and the user support mounting device which defines a user support pivot axis which permits swiveling of the user support relative to the user support mounting device during an exercise at least through arcuate paths each side of a central, forward facing position of the user support, whereby rotation of the user support about the user support pivot axis comprises a user-controlled, pivoting movement throughout the exercise;

a centering mechanism which orients the user support in the central, forward facing position in a rest or exercise start position, the centering mechanism comprising first and second co-operating parts, one of the parts being located on the user support and the other part being located on the user support mounting device; and the first and second parts comprising magnets which bias the user support towards the central position by magnetic attraction between poles of the magnets.

35. An exercise machine, comprising:

a stationary main frame laving a forward end, a rear end, and opposite sides;

a user support mounting device associated with the main frame;

a user support which is adapted to support a user in an exercise position while performing an exercise;

a pivotal connection between the user support and the user support mounting device which defines a user support pivot axis which permits swiveling of the use support relative to the user support mounting device during an exercise at least through arcuate paths on each side of a central, forward facing position of the user support, whereby rotation of the user support about the user support pivot axis comprises a user-controlled, pivoting movement throughput the exercise; and a centering mechanism which orients the user support in the central, forward facing position in a rest or exercise start position;

wherein the user support pivot axis is vertical in at least a rest or exercise start position.

36. The machine of claim 35, wherein the centering mechanism comprises first and second co-operating parts, one of the parts being locate on the user support and the other part being located on the user support mounting device, the first part comprises a releasable locking device and the second part has a single, central opening for releasably receiving the locking device when the seat is in the central position, the first part including a biasing mechanism for biasing the locking device into the opening when the user support is in the central, forward facing position.

37. The machine of claim 36, wherein the centering mechanism further comprises a manually operable actuator movable between a first, inoperative position and it second, operative position in which the actuator holds the locking device in a retracted position, the user support swiveling freely along the arcuate path through the central position when the locking device is held in the retracted position.

38. The machine of claim 35, wherein the user support mounting device is rigidly mounted on the main frame.

39. The machine of claim 35, wherein user support mounting device, is pivotally mounted on the main frame for rotation about a second pivot axis which is oriented at an angle to the user support pivot axis.

40. The machine of claim 39, wherein the second pivot axis is horizontal.

41. The machine of claim 35, further comprising at least one exercise arm which is movably associated with at least one of the main frame, user support mounting device, and user support, wherein the exercise arm is configured for engagement by a user to perform an exercise while positioned on the swiveling user support.

42. The machine of claim 41, wherein the user support mounting device is pivotally mounted on the main frame for rotation about a second pivot axis extending at an angle to the user support pivot axis, and a connecting link associated with the exercise arm translates movement of the exercise arm into rotation of the user support mounting device about the second pivot axis.

43. The machine of claim 35, wherein the user support comprises a base support and a seat pad mounted on the base support which is adapted to support a user in a seated exercise position, the user support pivot axis extending in a direction generally transverse to the seat pad.

44. The machine of claim 43, further comprising at least one stabilizing support secured to the seat base support and traveling together with the seat pad about the seat pivot axis.

45. An exercise machine, comprising:

a stationary main frame having a forward end, a rear end, and opposite sides;

a user support mounting device associated with the main frame;

a user support which is adapted to support a user in an exercise position while performing an exercise;

pivotal connection between the user support and the user support mounting device which defines a user support pivot axis which permits swiveling of the user support relative to the user support mounting device during an exercise at least through arcuate paths on each side of a central, forward facing position of the use support, whereby rotation of the user support about the user support pivot axis during an exercise comprises a user-controlled swivel movement;

a user engagement device movably associated with one of the main frame, user support, and user support mounting device which is adapted for engagement by a user to perform an exercise while positioned on the free swiveling user support;

a centering device between the user support mounting device and user support which releasably holds the user support in the central, forward facing position, the centering device comprising first and second parts, one of the parts being located on the user support and the other part being located on the user support mounting device;

the first part comprising a releasable locking device which is movable between a retracted position and an advanced position, and the second part having only one opening adapted to receive the locking device, the one opening defining a central, forward facing position of the user support and being adapted to align with and receive the locking device when the user support is in the central position; and the locking device including a biasing mechanism for biasing the locking device from the retracted position into an advanced position engaging in the one opening in the first part when the user support is in the central, forward facing position.

46. The machine of claim 45, wherein the second part has guides on each side of the central opening which are configured to engage the locking device and urge the locking device towards the retracted, spring biased position as the user support is rotated in either direction towards the central position, each guide being configured to release the locking device when the user support is in the central, forward facing position, whereby the locking device is biased into an extended position engaging said opening in the second part.

* * * * *